US010101684B2

(12) United States Patent
Kyotani et al.

(10) Patent No.: US 10,101,684 B2
(45) Date of Patent: Oct. 16, 2018

(54) IMAGE FORMING APPARATUS AND CARTRIDGE COMPRISING DETECTION GEAR

(71) Applicant: BROTHER KOGYO KABUSHIKI KAISHA, Nagoya-shi, Aichi-ken (JP)

(72) Inventors: Tadao Kyotani, Nagoya (JP); Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/431,412

(22) Filed: Feb. 13, 2017

(65) Prior Publication Data

US 2017/0261884 A1 Sep. 14, 2017

(30) Foreign Application Priority Data

Mar. 11, 2016 (JP) ..... 2016-047809

(51) Int. Cl.
*G03G 15/08* (2006.01)
*G03G 21/18* (2006.01)

(52) U.S. Cl.
CPC ..... *G03G 15/0863* (2013.01); *G03G 15/0865* (2013.01); *G03G 21/1892* (2013.01); *G03G 21/1896* (2013.01)

(58) Field of Classification Search
CPC ..... G03G 15/0863; G03G 15/0865
USPC ..... 399/12
See application file for complete search history.

(56) References Cited

U.S. PATENT DOCUMENTS 6,587,649 B1 7/2003 Yamamoto et al.
7,623,255 B2 * 11/2009 Simpson ..... G06F 21/34 347/2
2004/0042804 A1 3/2004 Yamamoto et al.
2006/0193646 A1 * 8/2006 Suzuki ..... G03G 21/1896 399/12
2006/0216046 A1 * 9/2006 Hatakeyama ..... G03G 15/0856 399/27
2007/0122165 A1 5/2007 Igarashi et al.
2015/0063833 A1 * 3/2015 Shinagawa ..... G03G 15/556 399/12

(Continued)

FOREIGN PATENT DOCUMENTS

JP 2001-117440 A 4/2001
JP 2006-201430 A 8/2006
JP 2007-072123 A 3/2007

(Continued)

OTHER PUBLICATIONS

International Search Report and Written Opinion from corresponding International Patent Application No. PCT/JP2017/005104 dated Apr. 4, 2017.

(Continued)

*Primary Examiner* — Sandra Brase
(74) *Attorney, Agent, or Firm* — Merchant & Gould P.C.

(57) ABSTRACT

A cartridge includes a detection gear and a memory. The detection gear may be rotatable about a first axis extending in a predetermined direction. The detection gear may include a first protrusion movable with rotation of the detection gear. The memory may include a first storage region configured to store, based on the motion of the first protrusion, new product determination information representing that the cartridge is detected as a new product.

23 Claims, 25 Drawing Sheets

(56) References Cited

U.S. PATENT DOCUMENTS

| | | | |
|---|---|---|---|
| 2015/0192880 | A1 | 7/2015 | Noda et al. |
| 2017/0261883 | A1 | 9/2017 | Kyotani |

FOREIGN PATENT DOCUMENTS

| | | | |
|---|---|---|---|
| JP | 2007-148285 | A | 6/2007 |
| JP | 2008-242085 | A | 10/2008 |
| JP | 2015-099219 | A | 5/2015 |
| JP | 2015-129815 | A | 7/2015 |
| JP | 2015-180545 | A | 10/2015 |

OTHER PUBLICATIONS

International Search Report and Written Opinion from corresponding International Patent Application No. PCT/JP2016/089048, dated Mar. 7, 2017.
U.S. Appl. No. 15/404,680, filed Jan. 12, 2017.
Office Action issued in related U.S. Appl. No. 15/404,680, dated Nov. 15, 2017.
English translation of International Search Report and Written Opinion from corresponding International Patent Application No. PCT/JP2017/005104 dated Apr. 4, 2017.
English translation of International Search Report and Written Opinion previously submitted, from corresponding International Patent Application No. PCT/JP2016/089048 dated Mar. 7, 2017.
Office Action issued in related U.S. Appl. No. 15/404,680, dated Apr. 2, 2018.

* cited by examiner

IMAGE FORMING APPARATUS AND CARTRIDGE COMPRISING DETECTION GEAR

CROSS REFERENCE TO RELATED APPLICATION

This application claims priority from Japanese Patent Application No. 2016-047809 filed Mar. 11, 2016. The entire content of the priority application is incorporated herein by reference.

TECHNICAL FIELD

The present disclosure relates to a cartridge for use in an image forming apparatus, and also relates to an image forming apparatus provided with the cartridge.

BACKGROUND

An electro-photographic type image forming apparatus such as a laser printer and an LED printer is known in the prior art. A cartridge is attachable to and detachable from the image forming apparatus. The cartridge is configured to accommodate therein toner.

The number of printable sheets printed by the cartridge is defined as yield information. The image forming apparatus may monitor service life of the cartridge on the basis of the yield information. Such image forming apparatus and cartridge are described in the prior art.

SUMMARY

A cartridge including a detection gear is known. Upon attachment of the cartridge to the image forming apparatus, the detection gear can rotate and a sensor in the image forming apparatus can detect the detection gear as a signal. The image forming apparatus performs determination process as to whether the cartridge is a new cartridge and/or the image forming apparatus obtains yield information on the basis of the signal obtained from the sensor. With the configuration above, when the cartridge is once used and then the detection gear is return to its initial position where the detection gear at the time of shipment was initially positioned, the image forming apparatus described above recognizes that the attached cartridge is a new product. Accordingly, the service life management of the cartridge becomes difficult to be carried out exactly.

It is therefore an object of the disclosure to provide a cartridge and an image forming apparatus capable of suitably monitoring the service life of the cartridge.

According to one aspect, the disclosure provides a cartridge including a detection gear and a memory. The detection gear may be rotatable about a first axis extending in a predetermined direction. The detection gear may include a first protrusion movable with rotation of the detection gear. The memory may include a first storage region configured to store, based on the motion of the first protrusion, new product determination information representing that the cartridge is detected as a new product.

According to another aspect, the disclosure provides an image forming apparatus including a cartridge, a frame configured to hold the cartridge, a sensor configured to detect the motion of the first protrusion, and a controller. The cartridge may include a detection gear and a memory. The detection gear may be rotatable about a first axis extending in a predetermined direction. The detection gear may include a first protrusion movable with rotation of the detection gear. The memory may include a first storage region. The controller may be configured to determine whether a detection signal which is detected by the sensor is a new product waveform representing that the cartridge is a new product. The controller may be configured to write, in the first storage region, new product determination information representing that the cartridge is detected as a new product, when the detection signal is the new product waveform.

BRIEF DESCRIPTION OF THE DRAWINGS

The particular features and advantages of the disclosure will become apparent from the following description taken in connection with the accompanying drawings, in which.

DETAILED DESCRIPTION

An image forming apparatus according to a first embodiment will be described while referring to the accompanying drawings.

1. Structure of Image Forming Apparatus

Figure 1:
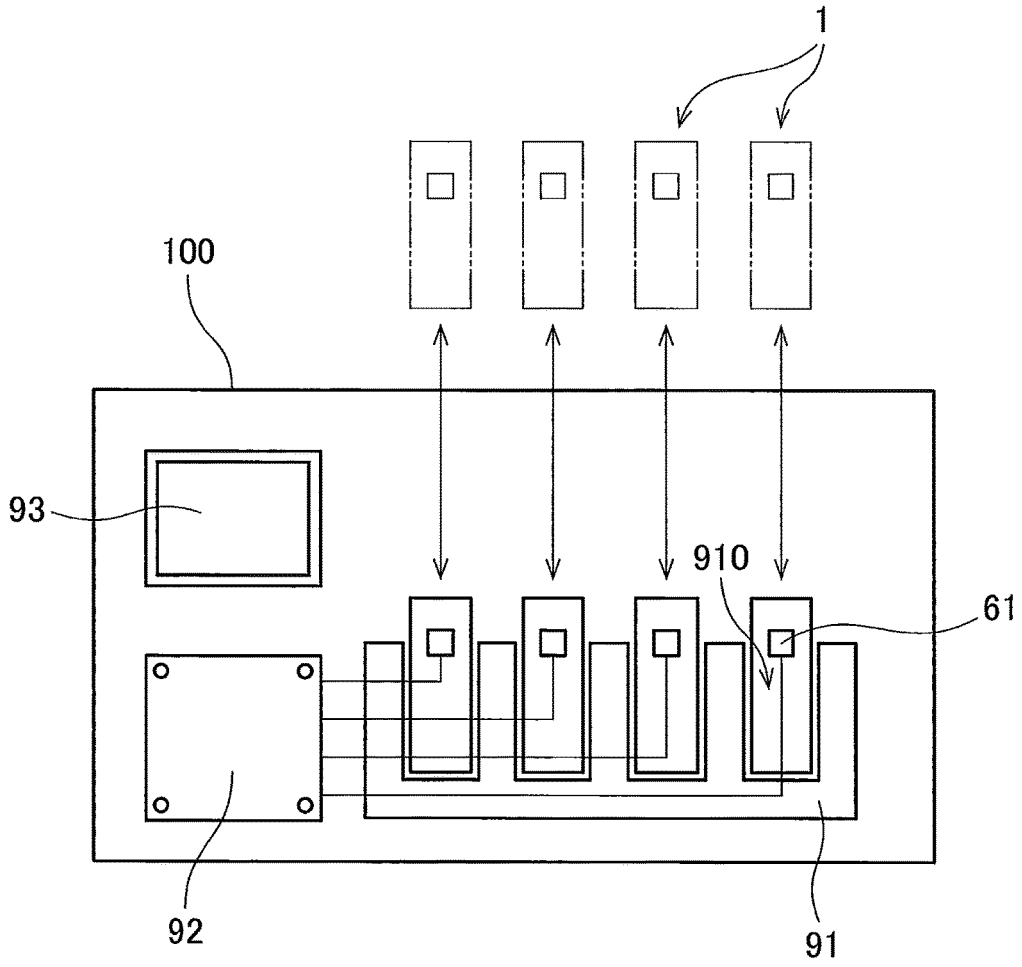
FIG. 1 is a conceptual diagram illustrating an image forming apparatus according to one embodiment.

An image forming apparatus 100 is illustrated in FIG. 1. The apparatus is an electro-photographic type printer, such as a laser printer and an LED printer. The image forming apparatus 100 includes four developing cartridges 1, a drawer unit 91, a controller 92, and a display 93. The drawer unit 91 is an example of a frame in which the four developing cartridges 1 can be held. The image forming apparatus 100 is configured to form an image on a sheet with developing agent such as toner supplied from each of the developing cartridges 1.

Figure 2:
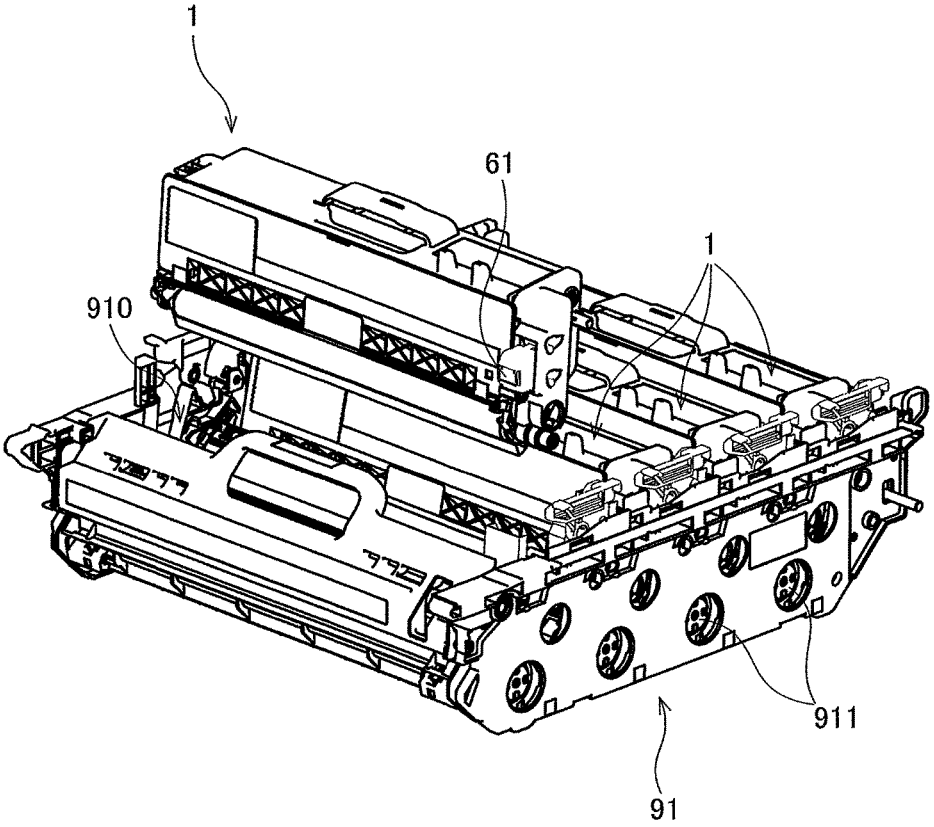
FIG. 2 is a perspective view of a drawer unit and a developing cartridge according to the embodiment.
Figure 3:
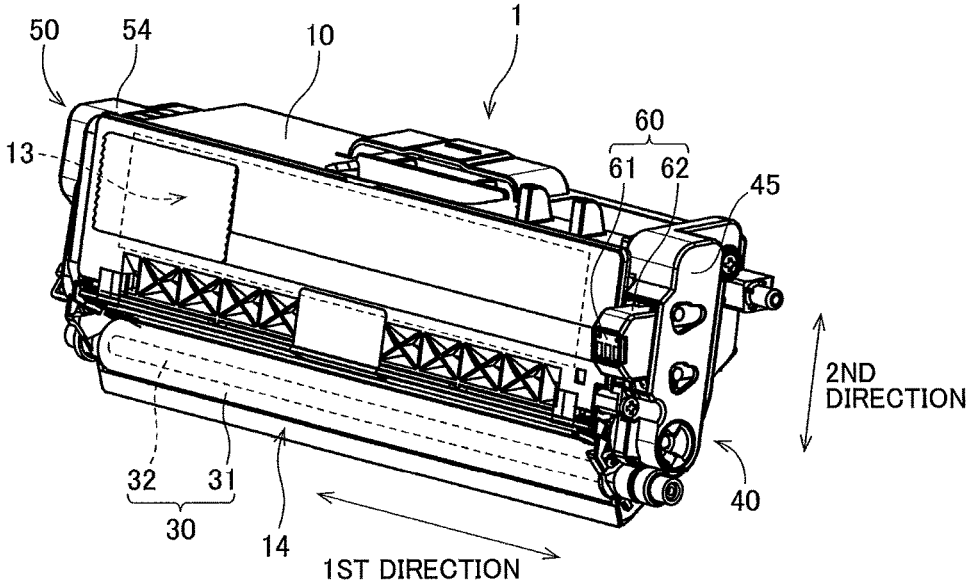
FIG. 3 is a perspective view of the developing cartridge according to the embodiment.
Figure 4:
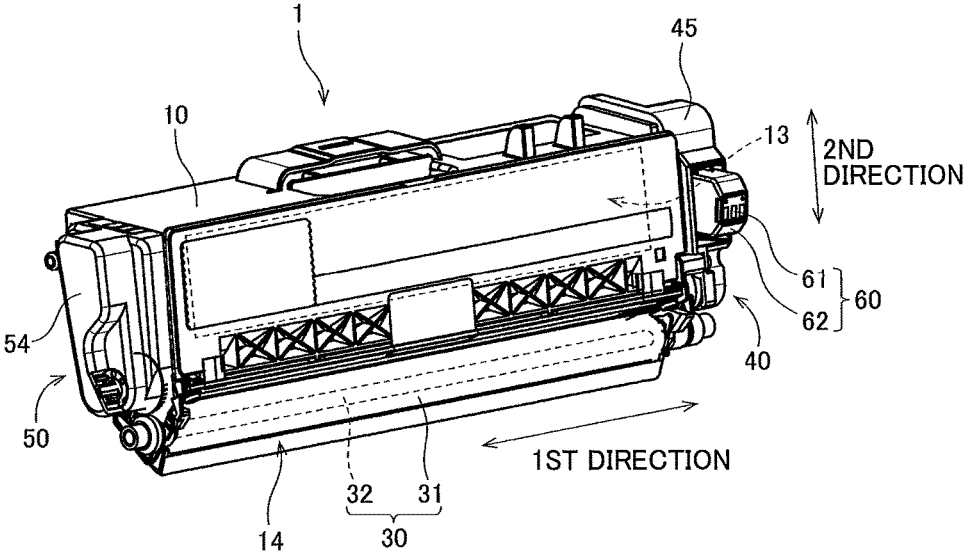
FIG. 4 is another perspective view of the developing cartridge according to the embodiment.

The drawer unit 91 and the developing cartridge 1 are illustrated in FIG. 2. Each of the four developing cartridges 1 can be replaced by a new cartridge in the drawer unit 91. To replace the developing cartridge 1 by a new cartridge, the drawer unit 91 is pulled out from a front side of the image forming apparatus 100. The drawer unit 91 includes a plurality of slots 910 that the developing cartridges 1 are detached from and attached into. A photosensitive drum 911 is provided at a position adjacent to the bottom portion of each slot 910.

In the embodiment, the four developing cartridges 1 are attached to the drawer unit 91. The four developing cartridges 1 accommodate therein developing agents of different colors such as cyan, magenta, yellow, and black, respectively. The number of the developing cartridges 1 to be attached to the drawer unit 91 is not limited to four, but from one to three cartridges or not less than five cartridges may be attached to the drawer unit 91. As illustrated in FIG. 1, each developing cartridge 1 includes a cartridge IC 61. The cartridge IC 61 is, for example, an IC chip being capable of reading and writing information.

The controller 92 includes a processor 921 (FIG. 11) such as a CPU, and one or more of memories. The controller 92 includes, for example, a circuit board. The controller 92 is configured to execute various processes in the image forming apparatus 100 by the operation of the processor 921 in accordance with one or more of programs store in the one or more of memories. By the attachment of the four developing cartridges 1 to the drawer unit 91, the cartridge IC 61 of each developing cartridge 1 is electrically connected to the controller 92. The display 93 is configured to display on a display screen various information relating to the operation of the image forming apparatus 100.

2. Structure of Developing Cartridge

As illustrated in FIGS. 3 through 6, the developing cartridge 1 includes a casing 10, agitator 20, developing roller 30, a first gear portion 40, a second gear portion 50 and a IC chip assembly 60.

Figure 5:
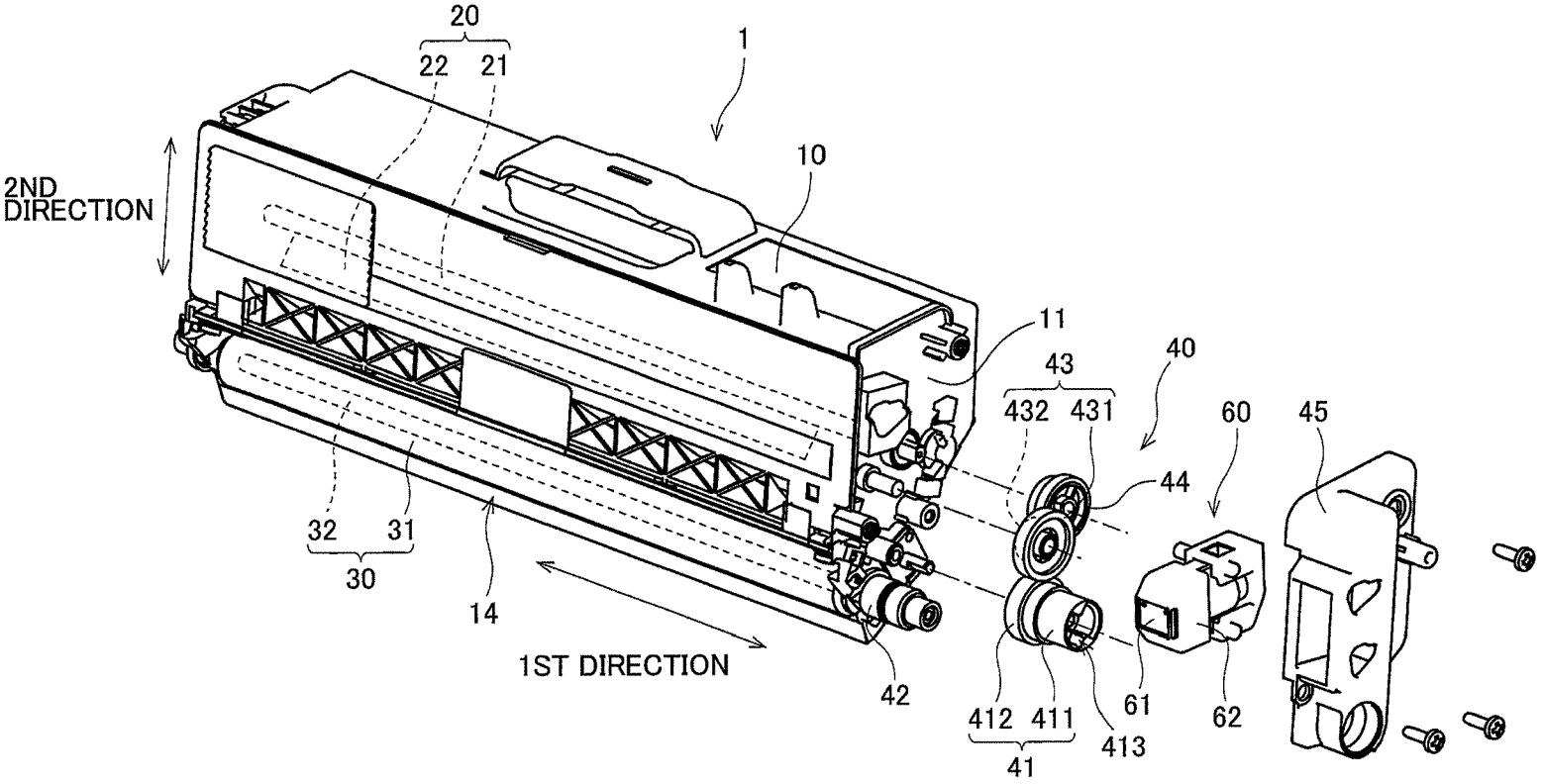
FIG. 5 is an exploded perspective view of the developing cartridge according to the embodiment.
Figure 6:
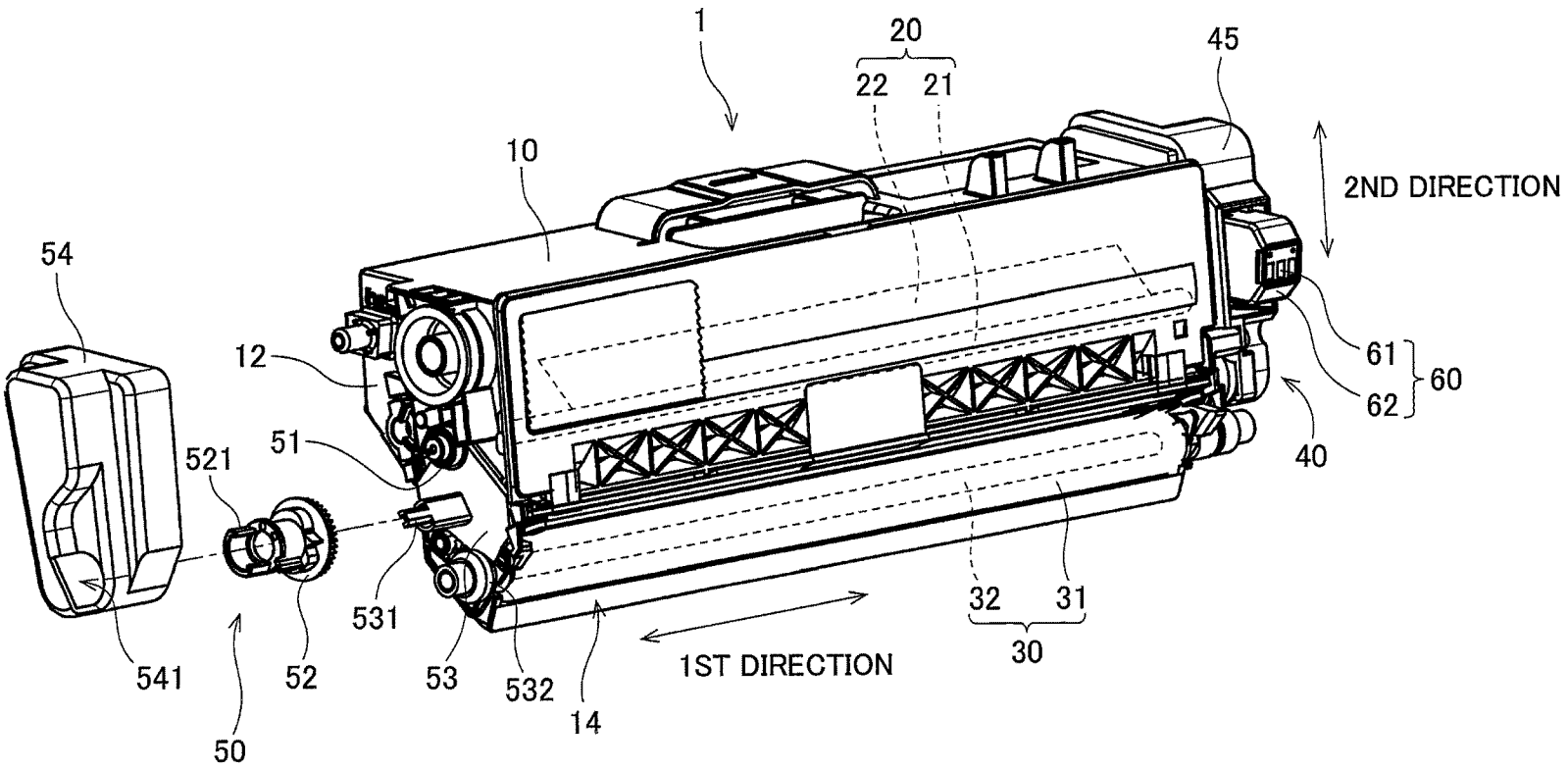
FIG. 6 is another exploded perspective view of the developing cartridge according to the embodiment.

The casing 10 is configured to accommodate therein developing agent. The casing 10 extends in a first direction between a first end face 11 (FIG. 5) and a second end face 12 (FIG. 6). The first gear portion 40 and the IC chip assembly 60 are positioned at the first end face 11, while the second gear portion 50 is positioned at the second end face 12. An accommodation chamber 13 is disposed in the casing 10 so as to accommodate a developing agent. The casing 10 has an opening 14 positioned at an end portion of the casing 10 in a second direction perpendicular to the first direction. The outside and inside of the accommodation chamber 13 are communicated with each other through the opening 14.

The agitator 20 includes an agitator shaft 21 and a blade 22. The agitator shaft 21 extends in the first direction, and the blade 22 extends radially outwardly from the agitator shaft 21. The blade 22 and at least portion of the agitator shaft 21 are positioned in the accommodation chamber 13. The agitator shaft 21 has one portion and another end portion in the first direction, and a first agitator gear 44 (described later) is mounted to the one end portion and a second agitator gear 51 (described later) is mounted to the other end portion, so that the agitator shaft 21 and the blade 22 are rotatable along with the rotation of the first agitator gear 44 and the second agitator gear 51. By the rotation of the blade 22, the developing agent in the accommodation chamber 13 is agitated.

The developing roller 30 is rotatable about a rotation axis (second axis) extending in the first direction, and is positioned at the opening 14 of the casing 10. The developing roller 30 includes a developing roller body 31 and the developing roller shaft 32. The developing roller body 31 is a hollow cylindrical member extending in the first direction and is made from an elastic material such as rubber. The developing roller shaft 32 is a rigid cylindrical member extending through the developing roller body 31 in the first direction. The developing roller shaft 32 is made from metal or electrically conductive resin. The developing roller body 31 is fixed to the developing roller shaft 32 so that the developing roller body 31 is not rotatable relative to the developing roller shaft 32.

The developing roller shaft 32 has one end portion in the first direction mounted to a developing roller gear 42 (described later) and fixed to the developing roller gear 42 so that the developing roller shaft 32 is not rotatable relative to the developing roller gear 42. Therefore, by the rotation of the developing roller gear 42, the developing roller shaft 32 is rotated, and the developing roller body 31 is also rotated along with the developing roller shaft 32.

Incidentally, the developing roller shaft 32 is not necessarily extends through the length of the developing roller body 31 in the first direction. Instead, a first developing roller shaft can extend from one end of the developing roller body 31, and a second developing roller shaft can extend from the other end of the developing roller body 31.

The developing cartridge 1 includes a supply roller (not shown). The supply roller is positioned between the developing roller 30 and the accommodation chamber 13, and is rotatable about a rotation axis (fourth axis) extending in the first direction. Upon receipt of driving force in the developing cartridge 1, the developing agent in the accommodation chamber 13 of the casing 10 is supplied to an outer peripheral surface of the developing roller 30 through the supply roller. In this case, the developing agent is triboelectrically charged between the developing roller 30 and the supply roller. On the other hand, bias voltage is applied to the developing roller shaft 32 of the developing roller 30. Accordingly, the developing agent is attracted to the outer peripheral surface of the developing roller body 31 by the electrostatic force between the developing roller shaft 32 and the developing agent.

The developing cartridge 1 also includes a toner layer thickness regulation blade (not shown). The blade is configured to form a developing agent layer formed on the outer surface of the developing roller body 31 into a uniform thickness. Then, the developing agent carried on the outer peripheral surface of the developing roller body 31 is supplied to the photosensitive drum 911 provided at the drawer unit 91. In this instance, developing agent is transferred from the developing roller body 31 to the photosensitive drum 911 so as to form a toner image corresponding to an electrostatic latent image formed on the photosensitive drum 911. Thus, a visible toner image is formed on the outer surface of the photosensitive drum 911.

The first gear portion 40 is positioned at the first end face 11 of the casing 10. As illustrated in FIG. 5, the first gear portion 40 includes a coupling 41, the developing roller gear 42, an idle gear 43, the first agitator gear 44 and a first cover 45. Incidentally, gear teeth of each of the gears are omitted in FIG. 5.

The coupling 41 is configured to receive driving force supplied from the image forming apparatus 100. The coupling 41 is rotatable about a rotation axis (third axis) extending in the first direction. The coupling 41 includes a coupling portion 411 and a coupling gear 412. The coupling portion 411 and a coupling gear 412 are made integrally from resin. The coupling portion 411 has an engagement hole 413 recessed in the first direction. A plurality of gear teeth are provided at an equal interval between neighboring teeth at an outer peripheral portion of the coupling gear 412.

When the drawer unit 91 to which the developing cartridge 1 is attached is mounted in the image forming apparatus 100, a drive shaft (not shown) of the image forming apparatus 100 is inserted into the engagement hole 413 of the coupling portion 411. Thus, the drive shaft and the coupling portion 411 are coupled, so that the driving shaft is not rotatable relative to the coupling portion 411. Accordingly, by the rotation of the drive shaft, the coupling portion 411 is rotated so that the coupling gear 412 is rotated along with the rotation of the coupling portion 411.

The developing roller gear 42 is configured to rotate the developing roller 30, and is rotatable about a rotation axis extending in the first direction. The developing roller gear 42 has an outer peripheral surface at which a plurality of gear teeth are provided along entire peripheral length thereof at equal interval between neighboring gears. The coupling gear 412 is in meshing engagement with the developing roller gear 42. The developing roller gear 42 is mounted to one end portion of the developing roller shaft 32 of the developing roller 30 in the first direction so that as the developing roller gear 42 is not rotatable relative to the developing roller shaft 32. Accordingly, by the rotation of the coupling gear 412, the developing roller gear 42 is rotated, and the developing roller 30 is rotated along with the rotation of the developing roller gear 42.

The idle gear 43 is configured to transmit rotation of the coupling gear 412 to the first agitator gear 44. The idle gear 43 is rotatable about a rotation axis extending in the first direction. The idle gear 43 includes a large diameter gear portion 431 and a small diameter gear portion 432 arrayed in the first direction. The small diameter gear portion 432 is positioned between the large diameter gear portion 431 and the first end face 11 of the casing 10. In other words, the large diameter gear portion 431 is positioned farther from the first end face 11 than the small diameter gear portion 432 is from the first end face 11. The small diameter gear portion 432 has an addendum circle having a diameter smaller than the diameter of the addendum circle of the large diameter gear portion 431. The large diameter gear portion 431 and the small diameter gear portion 432 are integrally made from resin.

A plurality of gear teeth are provided at an outer peripheral portion of the large diameter gear portion 431 along the entire peripheral length of the large diameter gear portion 431. A plurality of gear teeth are provided at an outer peripheral portion of the small diameter gear portion 432 along an entire peripheral length of the small diameter gear portion 432. The number of gear teeth of the small diameter gear portion 432 is smaller than the number of gear teeth of the large diameter gear portion 431. The large diameter gear portion 431 is in meshing engagement with the coupling gear 412, and the small diameter gear portion 432 is in meshing engagement with the first agitator gear 44. By the rotation of the coupling gear 412, the large diameter gear portion 431 is rotated, and the small diameter gear portion 432 is rotated along with the rotation of the large diameter gear portion 431, thereby rotating the first agitator gear 44.

The first agitator gear 44 is configured to rotate the agitator 20 positioned in the accommodation chamber 13, and is rotatable about a rotation axis extending in the first direction. A plurality of gear teeth are provided at an entire outer peripheral surface of the first agitator gear 44 at an equal interval between neighboring gear teeth. As described above, the small diameter gear portion 432 is in meshing engagement with the first agitator gear 44. Further, the first agitator gear 44 is mounted to one end portion of the agitator shaft 21 in the first direction so that the first agitator gear 44 is not rotatable relative to the agitator shaft 21. Accordingly, by the power transmission to the first agitator gear 44 from the coupling 41 through the idle gear 43, the first agitator gear 44 is rotated, and the agitator 20 is rotated along with the rotation of the first agitator gear 44.

The first cover 45 is fixed to the first end face 11 of the casing 10 by, for example, screws. The coupling gear 412, the developing roller gear 42, the idle gear 43, and the first agitator gear 44 are accommodated between the first cover 45 and the first end face 11. The engagement hole 413 of the coupling portion 411 is exposed to an outside of the first cover 45. The first cover 45 also functions as a holder cover for holding a holder 62 (described later) of the IC chip assembly 60.

The second gear portion 50 is positioned at the second end face 12 of the casing 10. As illustrated in FIG. 6, the second gear portion 50 includes the second agitator gear 51, a detection gear 52, an electrically conductive member 53, and a second cover 54. Incidentally, gear teeth of the second agitator gear 51 are omitted in FIG. 6.

The second agitator gear 51 is configured to transmit the rotation of the agitator shaft 21 to the detection gear 52. The second agitator gear 51 is rotatable about a rotation axis extending in the first direction. The second agitator gear 51 has an outer peripheral surface at which a plurality of gear teeth are provided along entire peripheral length of the plurality of gear teeth at equal interval between neighboring teeth. The second agitator gear 51 can be meshingly engaged with the detection gear 52 if the attached developing cartridge 1 is a new or unused cartridge. In other words, a portion of the gear teeth of the second agitator gear 51 can be meshingly engaged with a portion of the gear teeth of the detection gear 52, if the attached developing cartridge 1 is a new or unused cartridge. The second agitator gear 51 is mounted to another end portion of the agitator shaft 21 in the first direction so that the second agitator gear is not rotatable relative to the agitator shaft 21. Therefore, the second agitator gear 51 can be rotated by the rotation of the agitator shaft 21.

The detection gear 52 is configured to transmit information related to the developing cartridge 1 to the image forming apparatus 100. The information represents for example, whether the developing cartridge 1 is a new cartridge or a used cartridge. The information may represent specification of the developing cartridge 1 such as yield information including the amount of developing agent accommodated in the developing cartridge 1 or the number of printable sheets of the developing cartridge 1.

The detection gear 52 is rotatable about a rotation axis (first axis) extending in the first direction. The detection gear 52 includes a plurality of gear teeth which are provided at a portion of an outer peripheral surface of the detection gear 52. In other words, the detection gear 52 includes a plurality of gear teeth a toothless portion which are provided at the outer peripheral surface of the detection gear 52. When the drawer unit 91 to which a new developing cartridge 1 is attached is accommodated in the image forming apparatus 100, the coupling 41 receives driving force from the image forming apparatus 100. Thus, the second agitator gear 51 is rotated by the driving force transmitted from the coupling 41 through the idle gear 43, first agitator gear 44 and the agitator 20. The detection gear 52 is rotated by the meshing engagement with the gear teeth portion. However, when the detection gear 52 is rotated by a predetermined angle, the second agitator gear 51 is faced with the toothless portion so that the detection gear 52 is disengaged from the second agitator gear 51, thereby stopping rotation of the detection gear 52 because the detection gear 52 includes the plurality of gear teeth which are provided at a portion of an outer peripheral surface of the detection gear 52.

In this way, the second agitator gear 51 and the detection gear 52 are disengaged from each other in a case where the developing cartridge 1 is used. Therefore, if such a used cartridge 1 is detached from the image forming apparatus 100 and is then attached thereto, rotation of the second agitator gear 51 is not transmitted to the detection gear 52, so that the detection gear 52 does not rotate.

Incidentally, another gear may be disposed between the second agitator gear 51 and the detection gear 52. For example, the second gear portion 50 may include a second idle gear in meshing engagement with the second agitator gear 51 and the detection gear 52. In the latter case, the rotation of the second agitator gear 51 may be transmitted to the detection gear 52 through the second idle gear.

Figure 7:
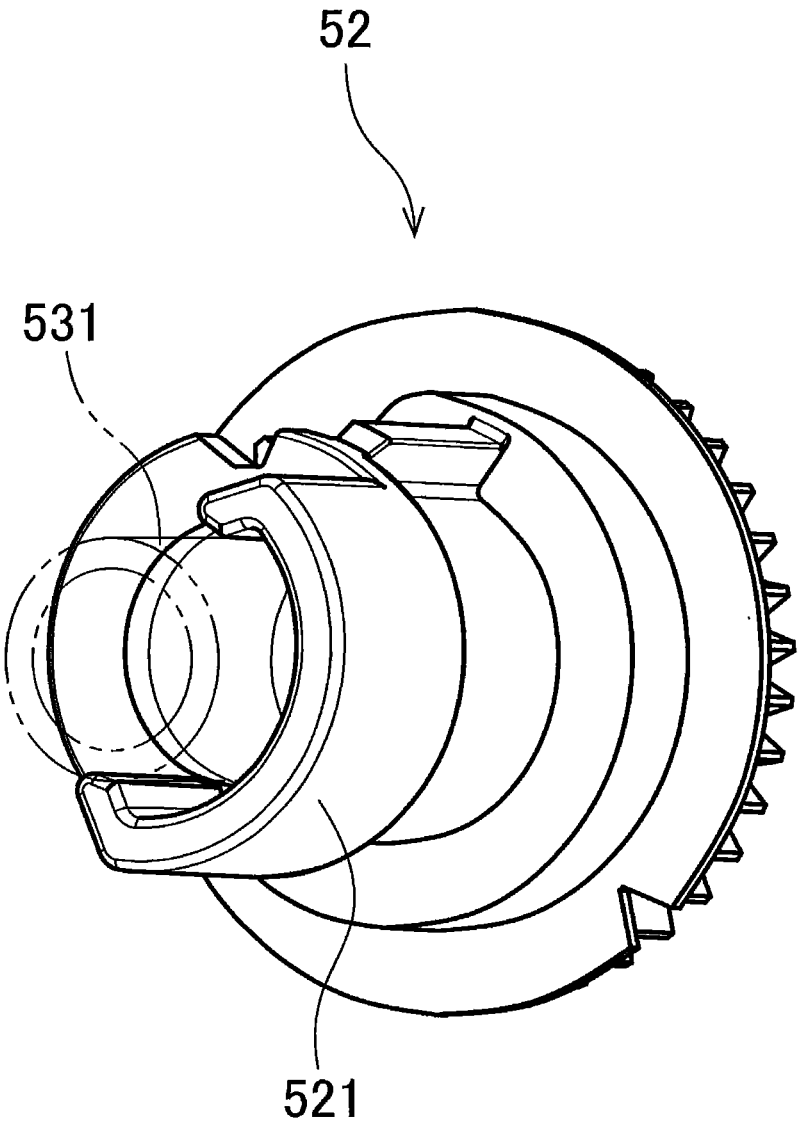
FIG. 7 is a perspective view of a detection gear of the developing cartridge according to the embodiment.

As illustrated in FIGS. 6 and 7, the detection gear 52 includes a first protrusion 521 protruding in the first direction. The first protrusion 521 has an arcuate shape extending with respect to the rotation axis of the detection gear 52. Upon rotation of the detection gear 52, the first protrusion 521 is rotatable about the rotation axis. That is, a position of the first protrusion 521 is changed in accordance with the rotation angle of the detection gear 52.

The electrically conductive member 53 is made from an electrically conductive material such as electrically conductive metal or electrically conductive resin. The electrically conductive member 53 is positioned at the second end face 12 of the casing 10. The electrically conductive member 53 includes a gear shaft 531 that has a hollow cylindrical shape extending in the first direction. The detection gear 52 is supported by the gear shaft 531 and is rotatable about the gear shaft 531. As illustrated in FIG. 7, the first protrusion 521 partly covers the peripheral portion of the gear shaft 531. Further, the electrically conductive member 53 includes a bearing portion 532 which is in contact with the developing roller shaft 32 of the developing roller 30.

The second cover 54 is fixed to the second end face 12 of the casing 10 by, for example, screws. The second agitator gear 51, the detection gear 52 and the electrically conductive member 53 are accommodated between the second cover 54 and the second end face 12. The second cover 54 has an opening 541. A portion of the first protrusion 521 and a portion of the gear shaft 531 are exposed outside of the second cover 54 through the opening 541. A lever 912 (described later) is in contact with one of the detection gear 52 and the gear shaft 531 through the opening 541.

3. Detection Mechanism

Figure 8:
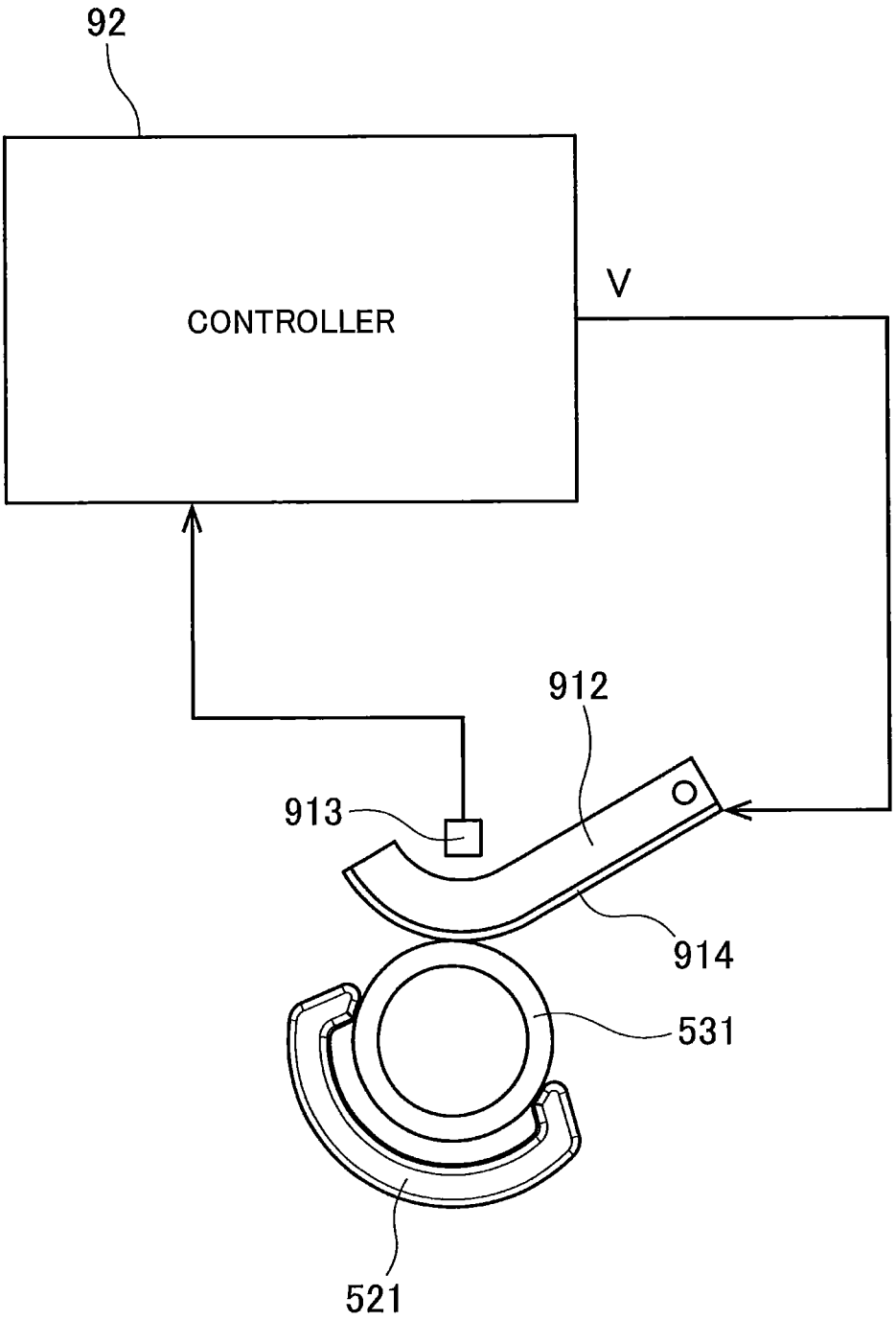
FIG. 8 is a view for description of a relationship among a first protrusion, a gear shaft, a lever, an optical sensor, and a controller according to the embodiment.
Figure 9:
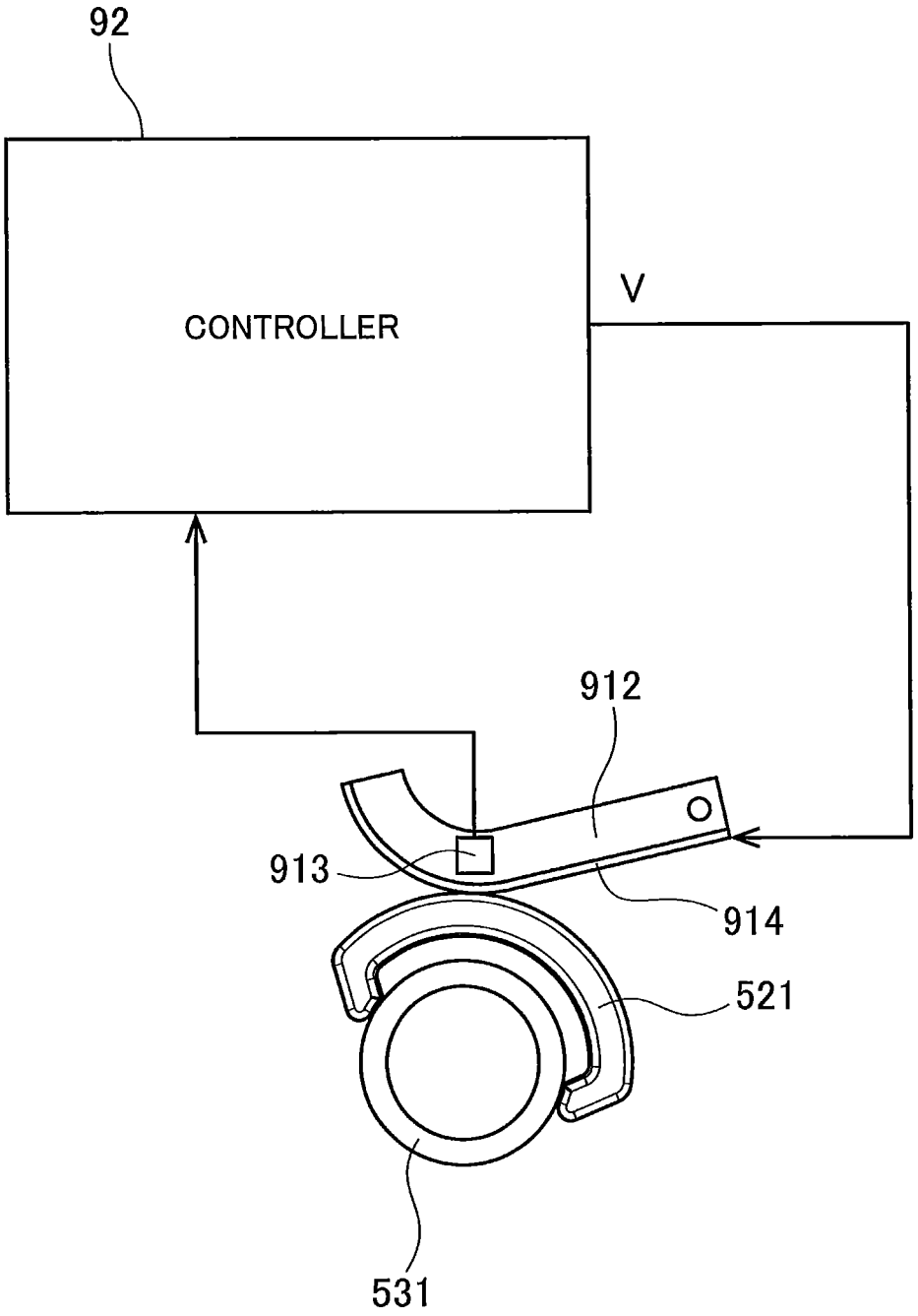
FIG. 9 is a view for description of the relationship among the first protrusion, the gear shaft, the lever, the optical sensor, and the controller according to the embodiment.

The drawer unit 91 includes the lever 912 and an optical sensor 913. FIGS. 8 and 9 illustrate a relationship among the first protrusion 521, the gear shaft 531, the lever 912, the optical sensor 913, and the controller 92. The lever 912 can contact with one of the gear shaft 531 and the first protrusion 521.

The lever 912 has a surface to which an electrically conductive metal plate 914 is attached. Electric power is supplied from the controller 92 to the metal plate 914. When the metal plate 914 is brought into contact with the gear shaft 531 as illustrated in FIG. 8, the metal plate 914, the electrically conductive member 53, and the developing roller shaft 32 are electrically connected to each other. During driving state of the image forming apparatus 100, the developing roller shaft 32 is applied with a predetermined bias voltage by electric power supplied from the metal plate 914.

As described above, the first protrusion 521 covers a portion of the outer peripheral surface of the gear shaft 531. Therefore, contacting state between the metal plate 914 and the gear shaft 531 is changed in accordance with the shape of the detection gear 52 during rotation of the detection gear 52 after attachment of a new developing cartridge 1 to the drawer unit 91. That is, the metal plate 914 is temporarily separated from the gear shaft 531 and is brought into contact only with the first protrusion 521 as illustrated in FIG. 9. In this way, the lever 912 is moved between a first position where the metal plate 914 is in contact with the gear shaft 531 and a second position where the metal plate 914 is separated from the gear shaft 531.

The optical sensor 913 is configured to detect a displacement of the lever 912 and transmit detection signals to the controller 92. The optical sensor 913 is a sensor unit having a light emitting portion and a light receiving portion. When the lever 912 is at the first position, light from the light emitting portion can be received in the light receiving portion without being interrupted by the lever 912. On the other hand, when the lever 912 is at the second position, the light from the light emitting portion is interrupted by the lever 912, so that the light cannot enter the light receiving portion. In this way, the optical sensor 913 can identify the position of the lever 912 to one of the first position and the second position in accordance with the entry or non-entry of the light at the light receiving portion. On the basis of the signals from the optical sensor 913, the controller 92 determines whether the attached developing cartridge 1 is a new cartridge or not, and/or identifies the specification of the attached developing cartridge 1.

In this way, the optical sensor 913 detects movement of the first protrusion 521 via the lever 912. However, the optical sensor 913 can directly detect the movement of the first protrusion 521. Instead of the optical sensor 913, a magnetic sensor and a contact type sensor may be used. Movement of the first protrusion 521 may be detected on the basis of electrical connection or disconnection between the electrically conductive metal plate 914 and the gear shaft 531.

In the embodiment, the gear shaft 531 is a portion of the electrically conductive member 53. Alternatively, a gear shaft may be provided independently from a power supply route to the electrically conductive member 53. For example, the second end face 12 of the casing 10 may have a through-hole and a cap covers the through-hole, and a gear shaft may be positioned on the cap so as to extend from the cap in the first direction.

4.1 IC Chip Assembly

The IC chip assembly 60 is positioned at an outer side of the first end face 11 of the casing 10. As illustrated in FIGS. 3 through 6, the IC chip assembly 60 includes the cartridge IC 61 and the holder 62. The cartridge IC 61 is an IC chip. The cartridge IC 61 is fixed to an outer surface of the holder 62 that is held to the first cover 45. The cartridge IC 61 has an electrical contact surface, which is made from an electrically conductive metal. The cartridge IC 61 includes a memory as a storage medium. Various information related to the developing cartridge 1 can be stored in the memory of the cartridge IC 61.

The drawer unit 91 includes an electrical connector provided at each of the slots 910. Each connector is electrically connected to the controller 92. As a result of the attachment of the developing cartridge 1 to the drawer unit 91, the electrical connector of the drawer unit 91 contacts the electrical contact surface of the cartridge IC 61, so that the image forming apparatus 100 can read information from the cartridge IC 61 and/or write information to the cartridge IC 61.

Figure 10:
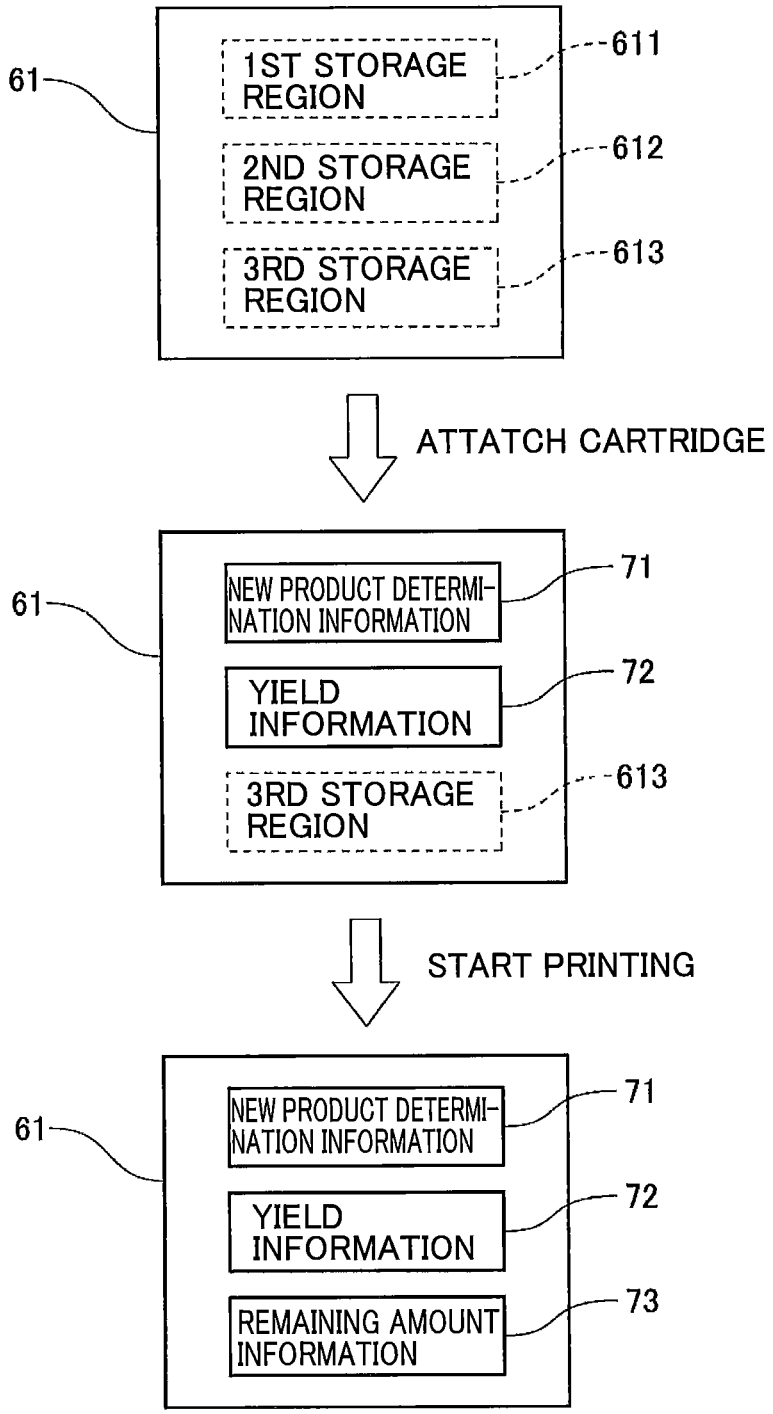
FIG. 10 is a conceptual diagram illustrating a storage region of a memory in a cartridge IC according to the embodiment.

As illustrated in FIG. 10 that schematically shows the cartridge IC 61, the cartridge IC 61 includes a first storage region 611, a second storage region 612, and a third storage region 613. The first storage region 611 can store the new product determination information 71. The new product determination information 71 represents that the developing cartridge 1 is already detected as a new product in the image forming apparatus 100. The second storage region 612 can store yield information 72 representing the amount of the developing agent in the developing cartridge 1 and/or the number of printable sheets by the developing agent. The third storage region 613 can store remaining amount information 73 representing the remaining amount of the developing agent in the developing cartridge 1.

When the developing cartridge 1 is shipped (which also may be a recycled developing cartridge), the new product determination information 71 is not stored in the first storage region 611. Further, when the developing cartridge 1 is shipped, the yield information 72 and the remaining amount information 73 are not stored in the second storage region 612 and the third storage region 613, respectively.

5. Controller

Figure 11:
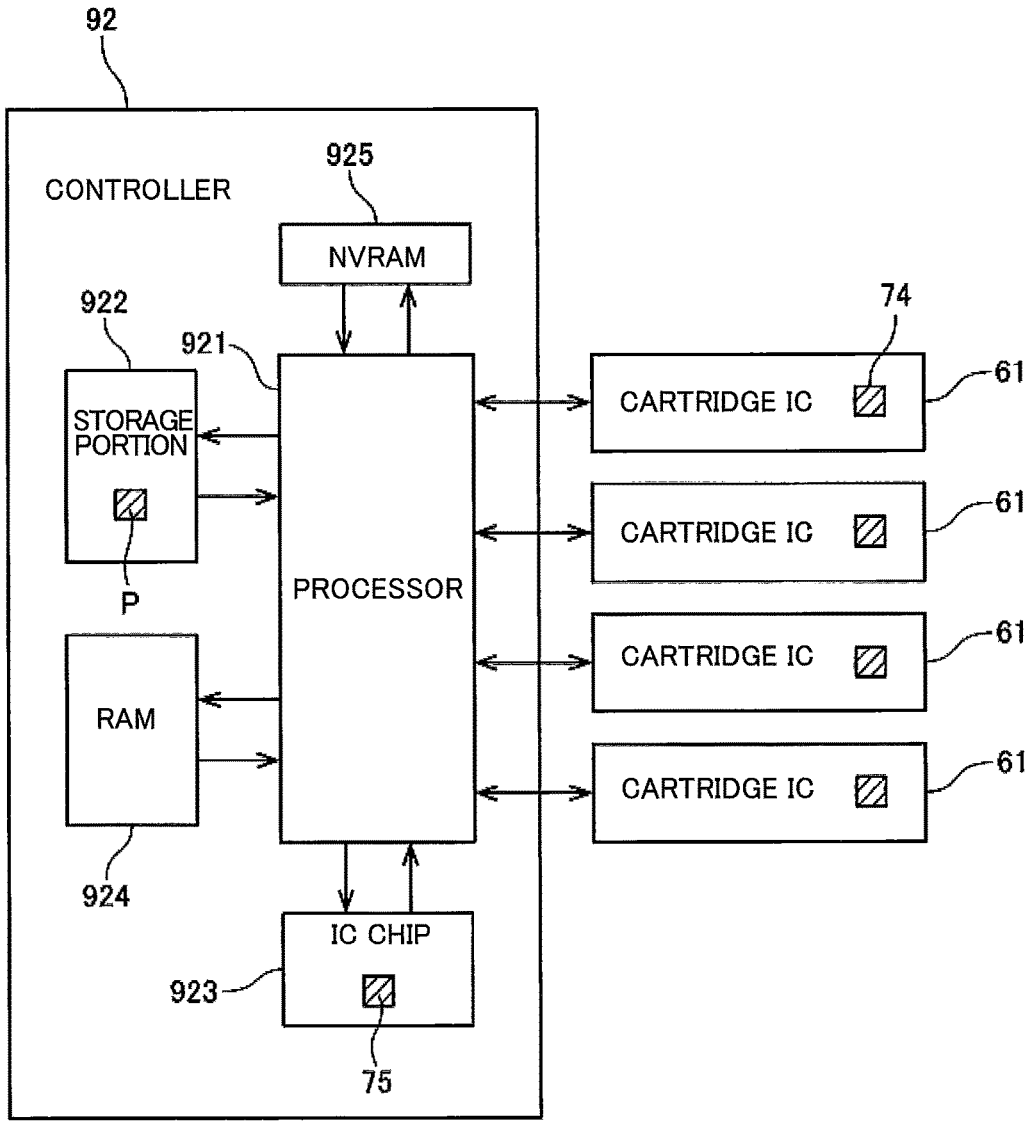
FIG. 11 is a conceptual block diagram illustrating a connection between the controller and the four cartridge ICs according to the embodiment.

As illustrated in FIG. 11, the controller 92 includes a processor 921, a memory 922, an IC chip 923, a RAM 924, and a NVRAM 925. The processor 921 is an arithmetic processing unit such as a CPU. The processor 921 is configured to write information into and/or read information from the storage portion 922, the IC chip 923, the RAM 924, and the NVRAM 925. Further, the processor 921 can perform writing and/or reading with respect to four cartridge ICs 61. The memory 922 stores program P to be read by the processor 921. The controller 92 is operated by executing the program P read from the memory 922 by the processor 921.

Each of the four cartridge ICs 61 stores first authentication information 74. Further, the IC chip 923 stores therein second authentication information 75 corresponding to the first authentication information 74. In an authentication processing described later, the processor 921 determines success or failure of the authentication by using the first authentication information 74 stored in the cartridge IC 61 and the second authentication information 75 stored in the IC chip 923.

The RAM 924 is a volatile memory capable of reading and/or writing information. The processor 921 sets information stored in the cartridge IC 61 on the RAM 924. Consequently, the processor 921 can promptly read information stored in the cartridge IC 61 from the RAM 924. Further, the processor 921 temporarily writes, in the RAM 924, information that should be written in the cartridge IC 61, and then copies the information from the RAM 924 to the cartridge IC 61.

The NVRAM 925 is a non-volatile memory capable of storing information even at shut off state of electric power. The NVRAM 925 stores therein information related to the developing cartridge 1. When a new developing cartridge 1 is attached to the image forming apparatus 100, the processor 921 initializes information related to the developing cartridge 1 stored in the NVRAM 925.

6. Process Executed after Attachment of Developing Cartridge

Figure 12:
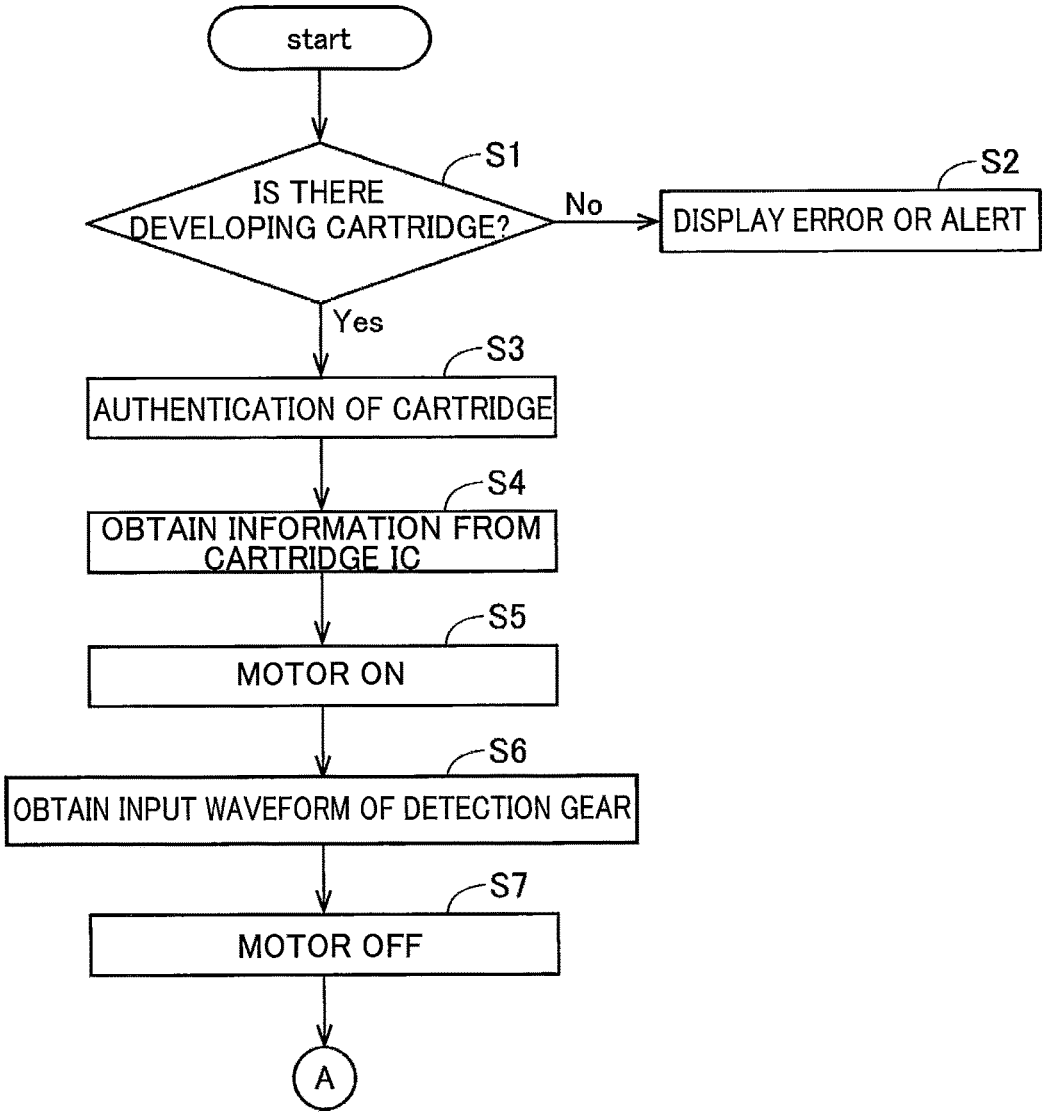
FIG. 12 is a flowchart illustrating a processing routine executed after attachment of the developing cartridge according to the embodiment.
Figure 13:
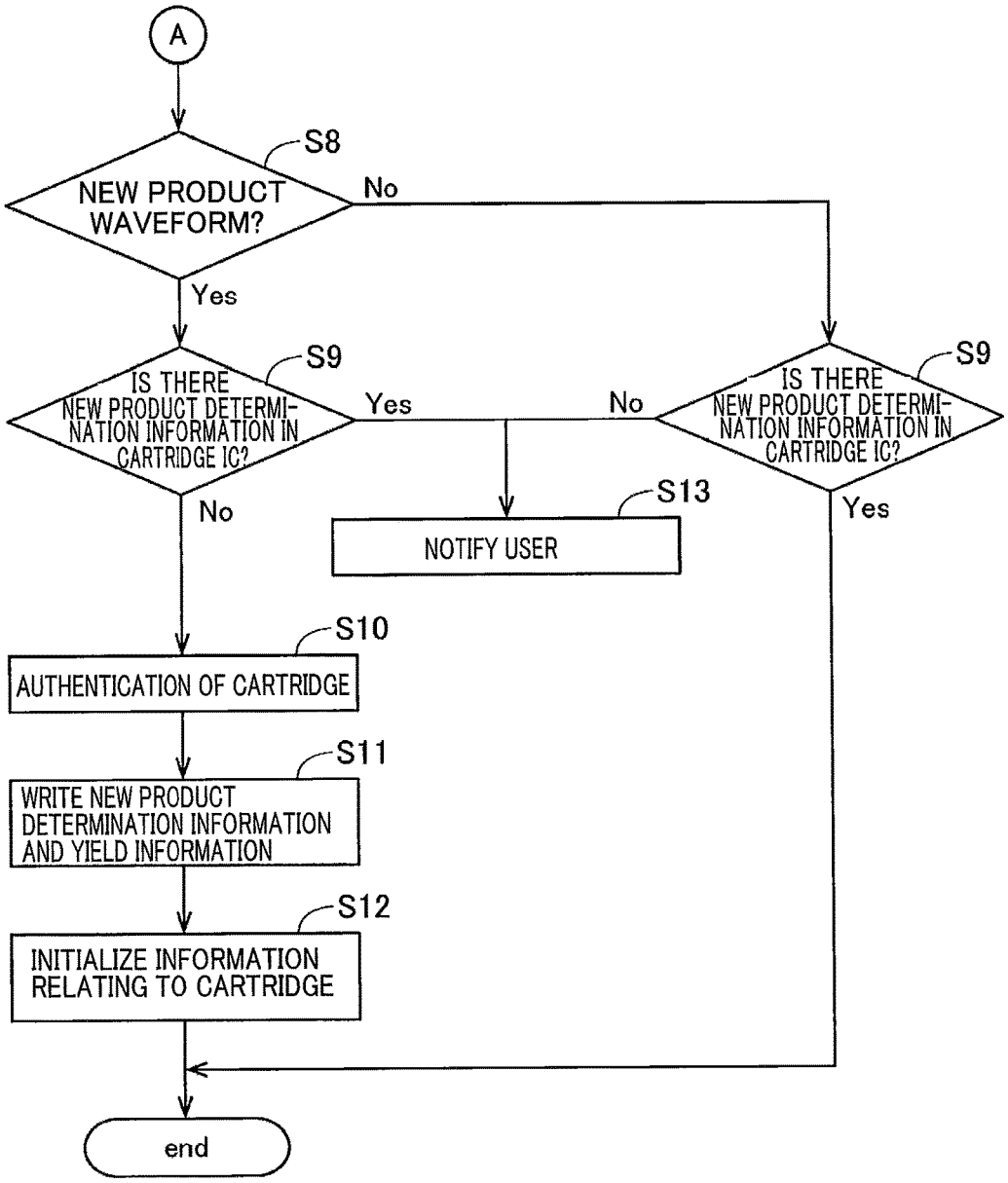
FIG. 13 is a flowchart illustrating the processing routine executed after attachment of the developing cartridge according to the embodiment.

Next, processing executed after attachment of the developing cartridge 1 will be described with reference to flowcharts illustrated in FIGS. 12 and 13. The following processing of the controller 92 is executed by the processor 921 in accordance with the program P. Further, the following description describes processing with respect to one developing cartridge 1. Similar processing is executed with respect to each of the four developing cartridges 1.

When the developing cartridge 1 is attached to the drawer unit 91, and the drawer unit 91 is accommodated in the image forming apparatus 100, the controller 92 confirms existence of the developing cartridge 1 (S1). The image forming apparatus 100 includes a cartridge sensor (not shown) for detecting existence of the developing cartridge 1 at each of the slots 910 of the drawer unit 91. The controller 92 determines existence of the developing cartridge 1 in each slot 910 on the basis of signal output from the cartridge sensor. Incidentally, the controller 92 can determine the existence of the developing cartridge 1 by making use of signal output from the optical sensor 913.

When the developing cartridge 1 is not set at the slot 910 of the drawer unit 91 (S1: No), the controller 92 displays error or warning in the display 93 (S2). Accordingly, the controller 92 notifies to a user of non-attachment of the developing cartridge 1 or insufficient attachment of the developing cartridge 1 to the slot 910 of the drawer unit 91.

On the other hand, when the drawer unit 91 determines that the developing cartridge 1 exists in the slot 910 of the drawer unit 91 in S1, the controller 92 authenticates the cartridge IC 61 (S3).

When the authentication of the cartridge IC 61 becomes successful, the controller 92 obtains or acquires information from the cartridge IC 61 (S4). More specifically, the controller 92 writes in the RAM 924 the information that is stored in the cartridge IC 61. When the new product determination information 71 is stored in the first storage region 611 of the cartridge IC 61, the controller 92 copies the new product determination information 71 to the RAM 924 from the first storage region 611. When the second storage region 612 of the cartridge IC 61 stores the yield information 72, the controller 92 copies the yield information 72 to the RAM 924 from the second storage region 612. When the third storage region 613 of the cartridge IC 61 stores the remaining amount information 73, the controller 92 copies the remaining amount information 73 to the RAM 924 from the third storage region 613.

Incidentally, when a new developing cartridge 1 is attached to the image forming apparatus 100 for the first time, none of the new product determination information 71, the yield information 72, and the remaining amount information 73 are stored in the cartridge IC 61. Accordingly, the controller 92 does not write the new product determination information 71, the yield information 72, and the remaining amount information 73 in the RAM 924.

Next, the controller 92 executes detection of a new product with respect to four developing cartridges 1. More specifically, the controller 92 permits the motor to start its driving to rotate the drive shaft (S5). Then, the rotation of the drive shaft is transmitted to the detection gear 52 through the coupling 41, the idle gear 43, the first agitator gear 44, agitator 20, and the second agitator gear 51. Thus, the detection gear 52 starts rotation. By the rotation of the detection gear 52, the first protrusion 521 is rotated. Inclination of the lever 912 is changed in accordance with the rotation of the first protrusion 521. The optical sensor 913 transmits to the controller 92 the detection signal that changes in accordance with the displacement of the lever 912. Accordingly, the controller 92 obtains or acquires input waveform changing in accordance with the rotation of the detection gear 52 (S6).

When the meshing engagement between the second agitator gear 51 and the detection gear 52 is released, the rotation of the detection gear 52 is stopped. Further, the controller 92 stops driving of the motor after elapse of predetermined time period after start timing of driving the motor (S7).

Then, the controller 92 determines whether the obtained or acquired input waveform is a new product wave form representing a new product (S8). The controller 92 determines whether the new product determination information 71 is stored in the first storage region 611 of the cartridge IC 61 by checking the information stored in the RAM 924 (S9). When the input waveform is the new product wave form and the new product determination information 71 is not stored in the RAM 924, the controller 92 determines that the developing cartridge 1 is a new product in a normal condition.

Then, the controller 92 authenticates the cartridge IC 61 (S10). The processing of the authentication is the same as the processing of S3.

When the controller 92 successfully authenticates the cartridge IC 61, the controller 92 writes the new product determination information 71 and the yield information 72 in the cartridge IC 61 (S11). The new product determination information 71 represents that the developing cartridge 1 is already detected as a new product. The yield information 72 represents the amount of the developing agent in the developing cartridge 1 and/or the number of printable sheets by the developing agent in the developing cartridge 1. The controller 92 determines the new product determination information 71 and the yield information 72 on the basis of the detection signal of the optical sensor 913 that changes in accordance with the motion of the first protrusion 521.

Specifically, in S11, the processor 921 writes the new product determination information 71 and the yield information 72 in the RAM 924. The controller 92 writes, into the cartridge IC 61, the new product determination information 71 and the yield information 72 that are stored in the RAM 924 periodically or on a case by case basis. For example, the controller 92 writes the new product determination information 71 in the first storage region 611 of the cartridge IC 61. The controller 92 writes the yield information 72 in the second storage region 612 of the cartridge IC 61.

The controller 92 then initializes the information relating to the developing cartridge 1 that is stored in the NVRAM 925 (S12), and waits for input of print instructions.

In a case where the RAM 924 stores the new product determination information 71 and the waveform is not the new product waveform, the controller 92 determines that the developing cartridge 1 is not a new product and is in a normal condition. This case specifically occurs when the developing cartridge 1 is detached from and attached again to the image forming apparatus 100. In this case, the controller 92 waits for the input of print instructions without rewriting or updating the information in the cartridge IC 61 and/or the NVRAM 925.

In a case where the RAM 924 stores the new product determination information 71 and the waveform is the new product waveform, the controller 92 determines that developing cartridge 1 is in a special condition different from the normal condition. Further, in a case where the RAM 924 does not store the new product determination information 71 and the waveform is not the new product waveform, the controller 92 determines that developing cartridge 1 is in a special condition different from the normal condition. In these special cases, the controller 92 displays a predetermined notification on the display 93 to notify a user that it is in the special condition (S13).

Accordingly, the developing cartridge 1 can store, in the cartridge IC 61, the new product determination information 71 obtained or acquired by the motion of the first protrusion 521 of the detection gear 52. On the basis of the information stored in the cartridge IC 61, the image forming apparatus 100 can determine whether the detection of a new product is already performed. The image forming apparatus 100 can therefore recognize the following special case: where the cartridge IC 61 stores the new product determination information 71 and the new product waveform is obtained or acquired from the detection gear 52, or where the cartridge IC 61 does not store the new product determination information 71 and the new product waveform cannot be obtained or acquired from the detection gear 52.

7. Remaining Amount Renewal Processing

Figure 14:
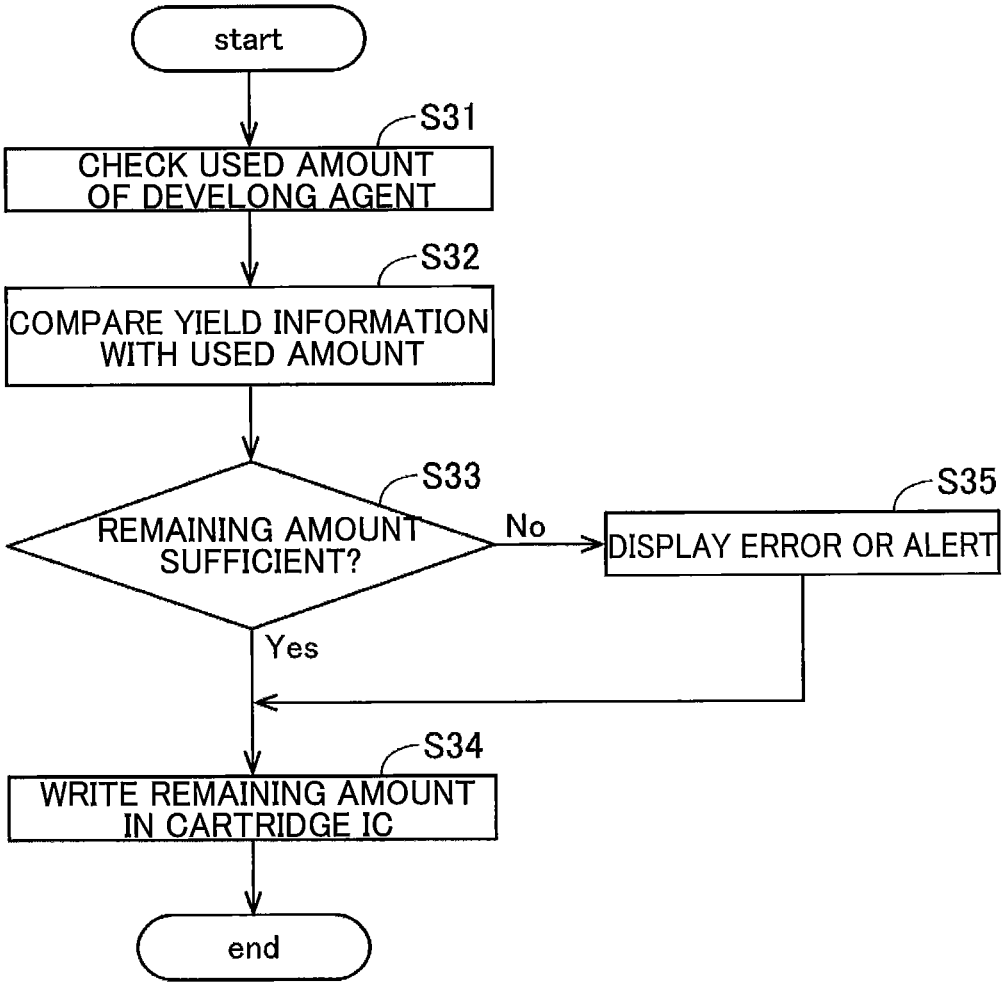
FIG. 14 is a flowchart illustrating a processing routine for renewal of information as to residual amount according to the embodiment.

The following describes the processing for updating the remaining amount information 73 stored in the third storage region 613, with reference to the flowchart in FIG. 14. After the controller 92 performs the processing in S1 through S12, the controller 92 repeatedly executes updating processing of the remaining amount information 73 in predetermined timing.

In the execution of the updating processing of the remaining amount information 73, the controller 92 confirms used amount of the developing agent (S31). The controller 92 stores the used amount of the developing amount in the RAM 924, and updates or renews the used amount at every time the controller 92 executes the print processing. As described above, the RAM 924 stores the yield information 72 obtained or acquired by the rotation of the detection gear 52.

The controller 92 compares the yield information 72 and the used amount of the developing agent (S32). The controller 92 determines the remaining amount information 73 that represents the remaining amount of the developing agent in the developing cartridge 1. For example, the controller 92 calculates the remaining amount information 73 by subtracting the used amount from the amount of the developing agent represented by the yield information 72.

After the controller 92 determines the remaining amount information 73, the controller 92 determines whether the remaining amount of the developing agent represented by the remaining amount information 73 is sufficient enough to execute the print processing (S33). Specifically, the controller 92 determines whether the remaining amount of the developing agent represented by the remaining amount information 73 is less than or equal to a threshold stored in the NVRAM 925. When the controller 92 does not determine that the remaining amount is less than or equal to the threshold, the controller 92 determines that the remaining amount of the developing agent is sufficient enough. After determining that the developing agent is sufficient, the controller 92 writes the remaining amount information 73 in the cartridge IC 61 (S34) and waits for input of the next print instruction. In S34, the processor 921 specifically writes the remaining amount information 73 in the RAM 924, and the controller 92 writes, in the third storage region 613 of the cartridge IC 61, the remaining amount information 73 stored in RAM 924 periodically or on a case by case basis.

On the other hand, when the controller 92 determines that the remaining amount of the developing cartridge is less than or equal to the threshold in S33, the controller 92 determines that the remaining amount of the developing agent is not sufficient. In the case where the remaining amount is not sufficient, the controller 92 displays an error message or alert on the display 93 (S35) and then write the remaining amount information 73 in the cartridge IC 61 (S34).

8. Modifications

Various modifications are conceivable.

8-1. First Modification

Figure 15:
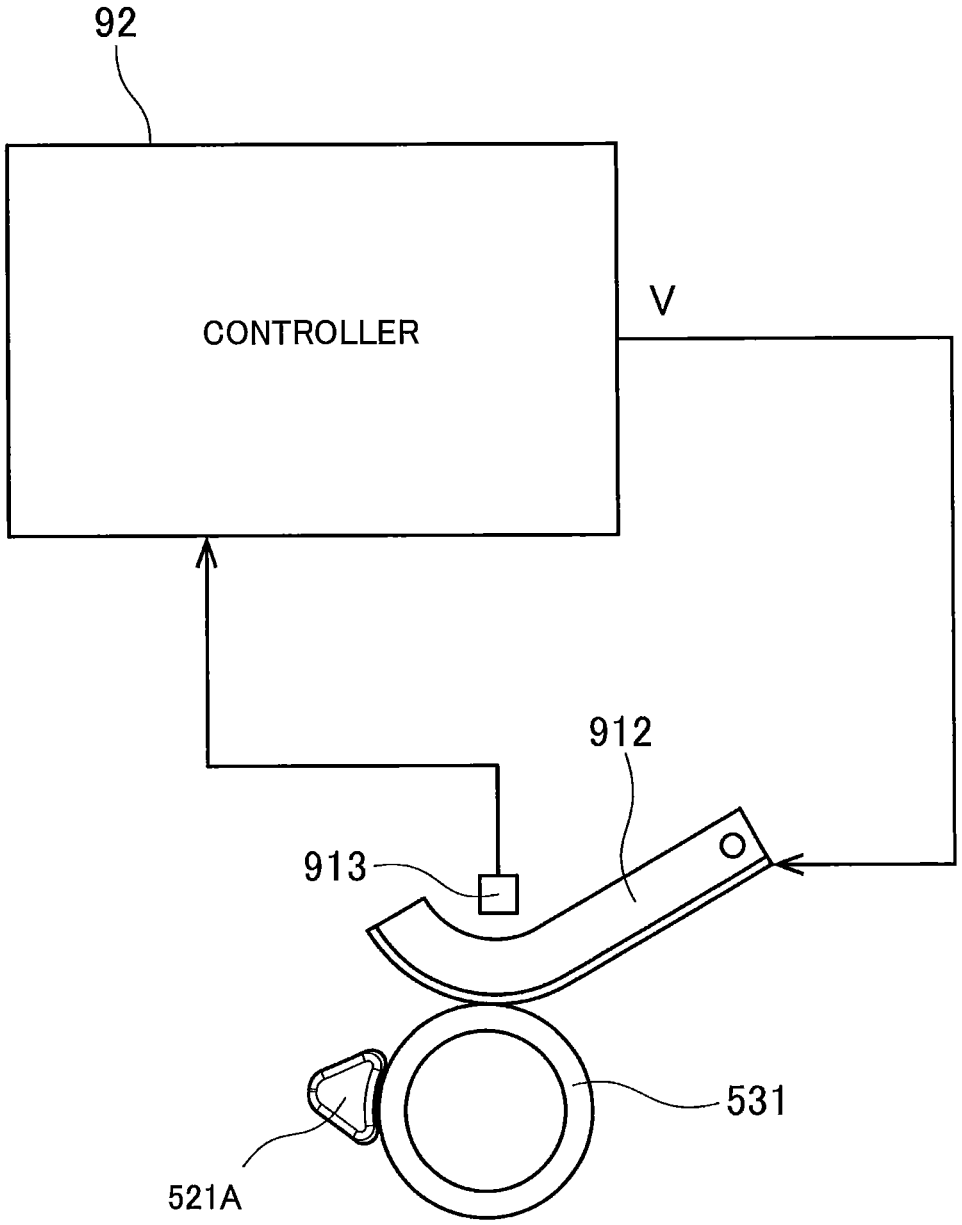
FIG. 15 is a view for description of a relationship among a first protrusion, a gear shaft, a lever, an optical sensor and a controller according to a first modification.

FIG. 15 illustrates a first modification wherein like parts and components are designated by the same reference numerals as those shown in the first embodiment. A relationship among a first protrusion 521A corresponding to the first protrusion 521, the gear shaft 531, the lever 912, the optical sensor 913, and the controller 92 is shown in FIG. 15. The first protrusion 521A has a circumferential length smaller than the circumferential length of the first protrusion 521 of the above-described embodiment. Accordingly, a time period during which the lever 912 is separated from the gear shaft 531 is shorter than the time period caused in the above-described embodiment. In this way, arcuate shape of the first protrusion 521 is not necessarily required.

8-2. Second Modification

Figure 16:
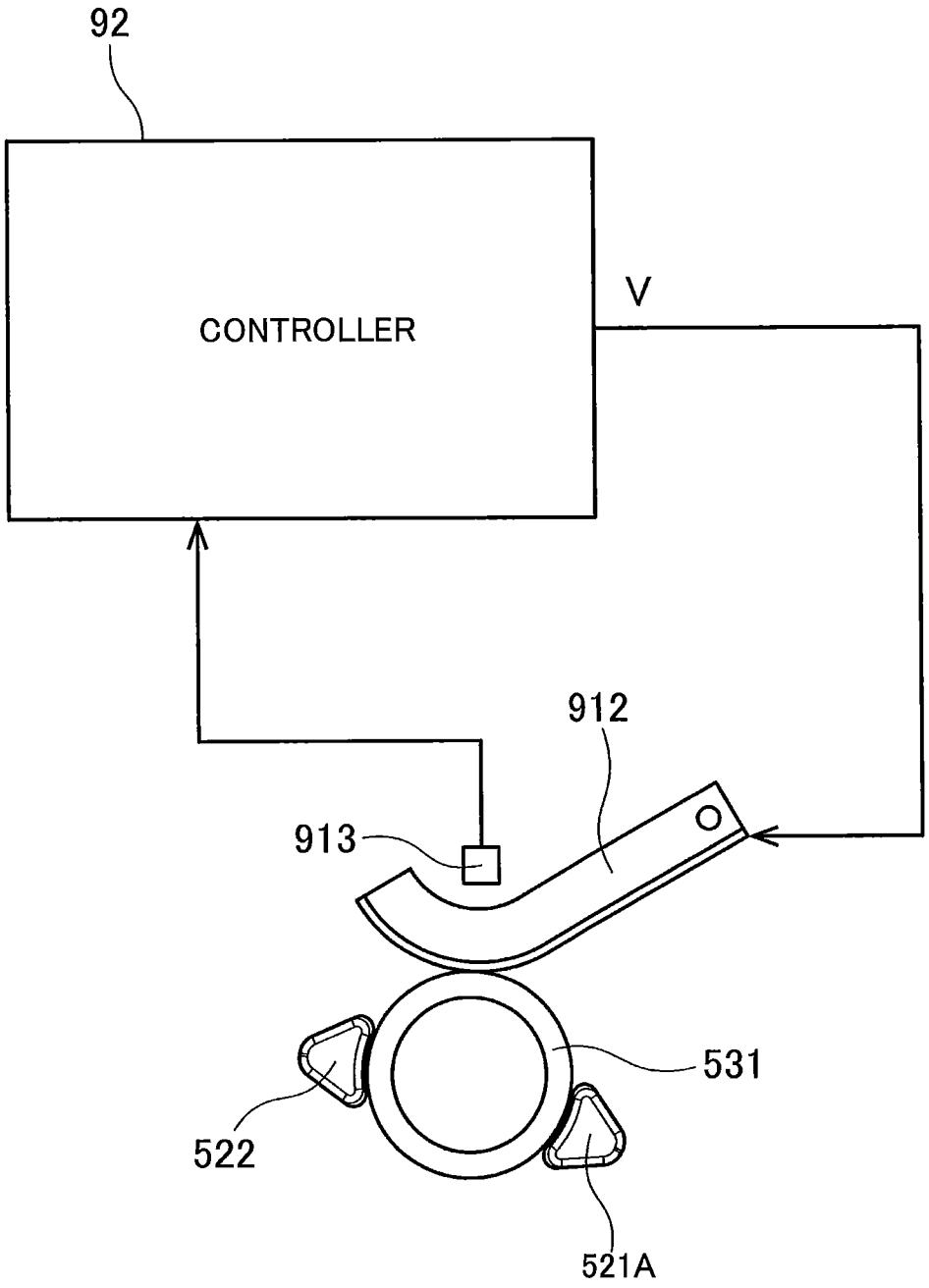
FIG. 16 is a view for description of a relationship among a first protrusion, a second protrusion, a gear shaft, a lever, an optical sensor and a controller according to a second modification.

FIG. 16 illustrates a second modification wherein like parts and components are designated by the same reference numerals as those shown in the first embodiment. A relationship among the first protrusion 521A, a second protrusion 522, the gear shaft 531, the lever 912, the optical sensor 913, and the controller 92 is shown in FIG. 16. According to the second modification, the detection gear 52 includes the first protrusion 521A, and the second protrusion 522. These protrusions 521A, 522 are positioned at circumferential positions different from each other and protrude in the first direction respectively. The first protrusion 521A has an outer end portion (first outer end portion) in a radial direction of the detection gear 52, and the second protrusion 522 has an outer end portion (second outer end portion) away from the first outer end portion in the circumferential direction of the detection gear 52.

When the developing cartridge 1 is attached to the image forming apparatus 100 and the detection gear 52 is rotated, positions of the first protrusion 521A and the second protrusion 522 are changed along with the detection gear 52. Therefore, the first protrusion 531A is brought into contact with the lever 912. Further, the second protrusion 522 is brought into contact with the lever 912 after or before the first protrusion 531A is in contact with the lever 912. Accordingly, in accordance with the rotation of the detection gear 52, the lever 912 is moved from the first position to the second position twice. The optical sensor 913 detects the movement of the lever 912 two times.

Accordingly, the two protrusions of the detection gear 52 can change the detection signal from the optical sensor in accordance with the circumferential length of the protrusions or intervals between the protrusions. That is, the two protrusions can represent a wide variety of yield information in accordance with the lengths of the protrusions or intervals between the protrusions.

8-3. Third Modification

Figure 17:
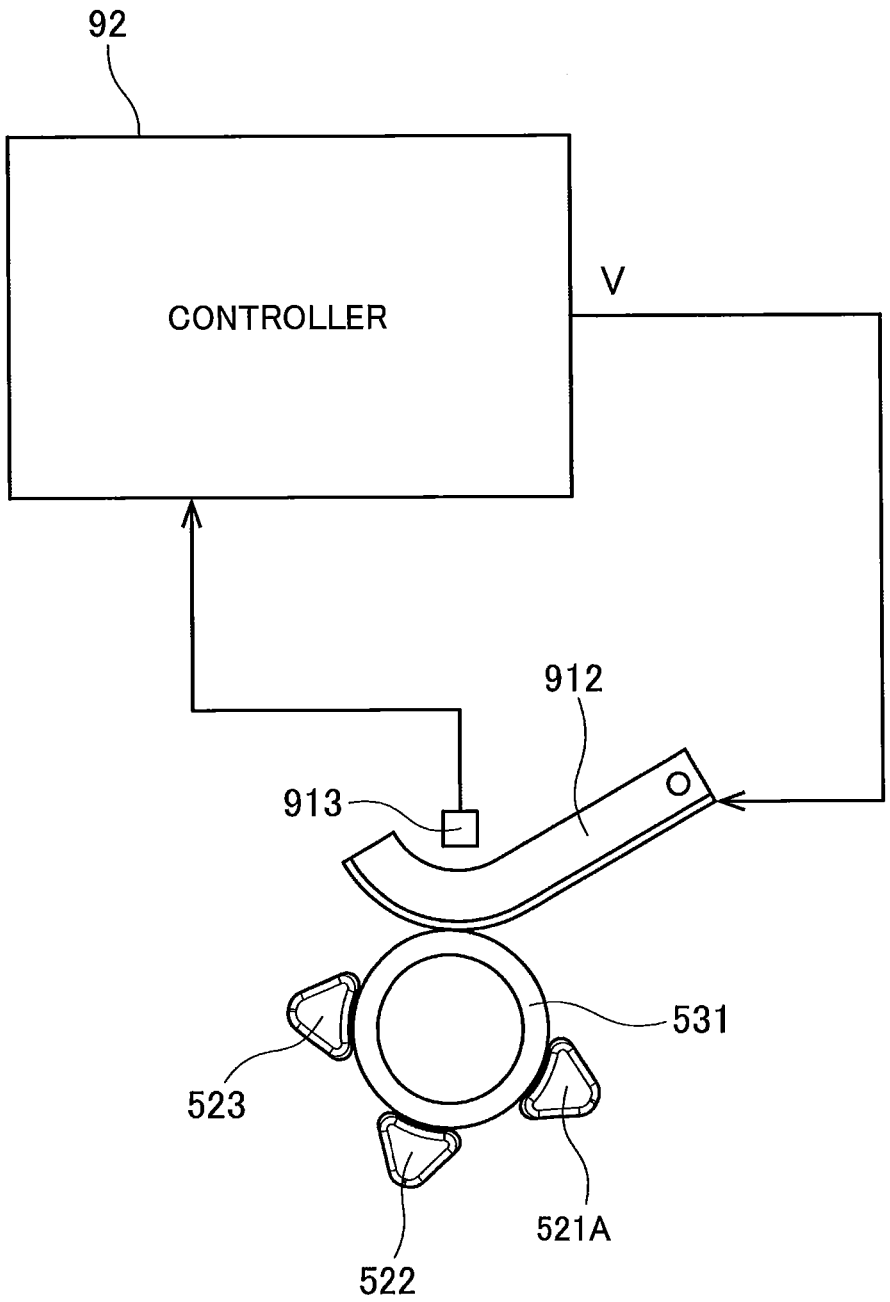
FIG. 17 is a view for description of a relationship among a first protrusion, a second protrusion, a third protrusion, a gear shaft, a lever, an optical sensor and a controller according to a third modification.

FIG. 17 illustrates a third modification wherein like parts and components are designated by the same reference numerals as those shown in the first embodiment. A relationship among the first protrusion 521A, the second protrusion 522, a third protrusion 523, the gear shaft 531, the lever 912, the optical sensor 913, and the controller 92 is shown in FIG. 17. According to the third modification, the detection gear 52 includes the first protrusion 521A, the second protrusion 522 and the third protrusion 523. These protrusions 521A, 522, 523 are positioned at circumferential positions different from each other. When the detection gear 52 is rotated, positions of the first protrusion 531A, the second protrusion 522 and the third protrusion 523 are changed along with the detection gear 52. Therefore, the first protrusion 531A is brought into contact with the lever 912. Further, the second protrusion 522 is brought into contact with the lever 912 after or before the first protrusion 521A is in contact with the lever 912. Accordingly, in accordance with the rotation of the detection gear 52, the lever 912 is moved from the first position to the second position thrice. The optical sensor 913 detects the movement of the lever 912 three times.

In this way, providing three protrusions at the detection gear 52 can change detection signal from the optical sensor in accordance with a distance between the protrusions and lengths of the protrusions in the circumferential direction. Consequently, positions and shapes of the three protrusions can provide various types of the yield information. Incidentally, more than four protrusions can be provided at the detection gear 52.

8-4. Fourth Modification

Figure 18:
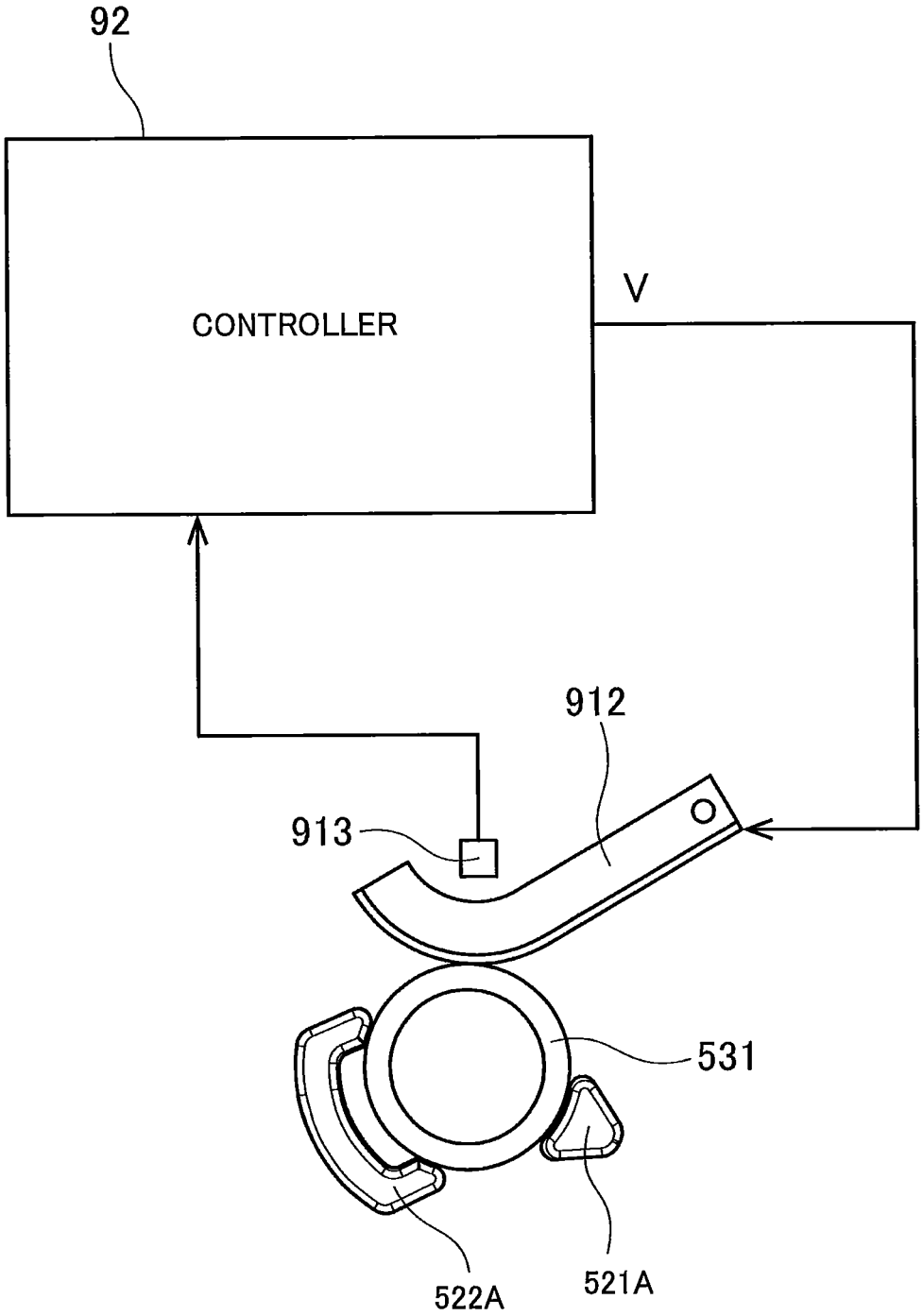
FIG. 18 is a view for description of a relationship among a first protrusion, a second protrusion, a gear shaft, a lever, an optical sensor and a controller according to a fourth modification.

FIG. 18 illustrates a fourth modification wherein like parts and components are designated by the same reference numerals as those shown in the first embodiment. A relationship among the first protrusion 521A, a second protrusion 522A, the gear shaft 531, the lever 912, the optical sensor 913, and the controller 92 is shown in FIG. 18. According to the fourth modification, the detection gear 52 includes the first protrusion 521A, and the second protrusion 522A. These protrusions 521A, 522A are positioned at circumferential positions different from each other and protrude in the first direction respectively. The first protrusion 521A has an outer end portion (first outer end portion) in the radial direction of the detection gear 52, and the second protrusion 522A has an outer end portion (second outer end portion) away from the first outer end portion in the circumferential direction of the detection gear 52A.

When the developing cartridge 1 is attached to the image forming apparatus 100 and the detection gear 52 is rotated, positions of the first protrusion 521A and the second protrusion 522A are changed along with the detection gear 52. Therefore, the first protrusion 521A is brought into contact with the lever 912. Further, the second protrusion 522A is brought into contact with the lever 912 after or before the first protrusion 521A is in contact with the lever 912. Accordingly, in accordance with the rotation of the detection gear 52, the lever 912 is moved from the first position to the second position twice. The optical sensor 913 detects the twice movement of the lever 912.

According to the modification illustrated in FIG. 18, the second protrusion 522A has a circumferential length greater than that of the first protrusion 521A. Therefore, a period of the second position of the lever 912 by the second protrusion 522A is longer than a period of the second position of the lever 912 by the first protrusion 521A. In this way, the controller 92 can detect the period of the second position of the lever 912 by the first protrusion 521A and the period of the second position of the lever 912 by the second protrusion 522A different from each other by setting the circumferential lengths of the first protrusion 521A and the second protrusion 522A different from each other. Consequently, increased numbers of yield information may be provided.

8-5. Fifth Modification

Figure 19:
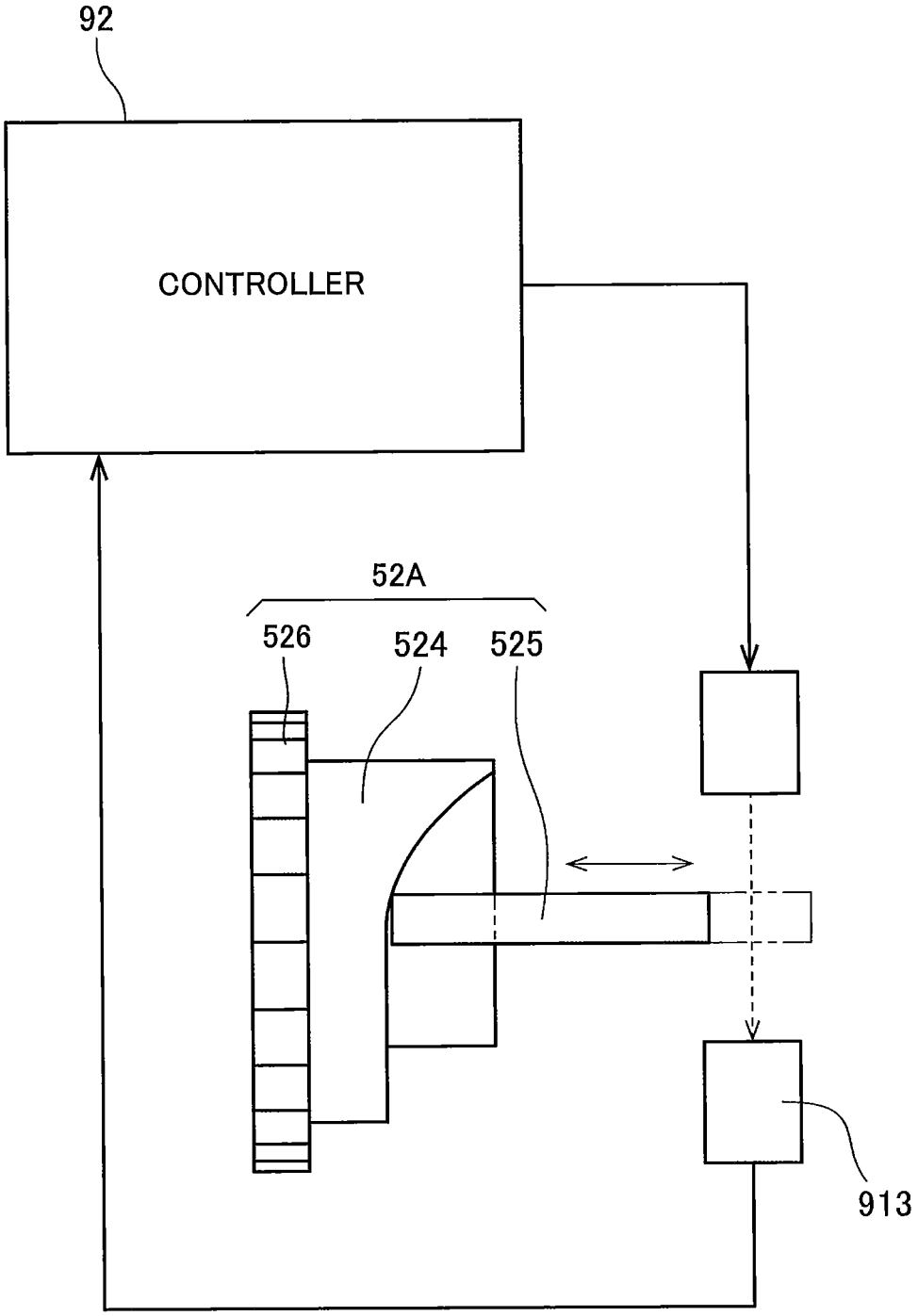
FIG. 19 is a view for description of a relationship among a detection gear, an optical sensor and a controller according to a fifth modification.

FIG. 19 illustrates a relationship among a detection gear 52A, a first protrusion 525, the optical sensor 913 and the controller 92. In this modification, the detection gear 52A includes a cam portion 524 and a first protrusion 525 that is a member separated from the cam portion 524. The detection gear 52A is rotatable about a rotation axis, and has a plurality of gear teeth 526 provided at a circumferential surface of the cam portion 524. By the rotation of the cam portion 524, the first protrusion 525 is moved in the axial direction in accordance with a surface shape of the cam portion 524. The optical sensor 913 transmits to the controller 92 the detection signal changing in accordance with the axial displacement of the first protrusion 525. The controller 92 obtains or acquires the yield information 72 and the new product determination information 71 as to the attached developing cartridge 1 on the basis of the detection signal obtained or acquired from the optical sensor 913.

In this way, the detection gear 52A may include a plurality of members, and the optical sensor 913 may detect a displacement of the member moving in the axial direction upon the rotation of the detection gear 52.

8-6 Sixth Modification

Figure 20:
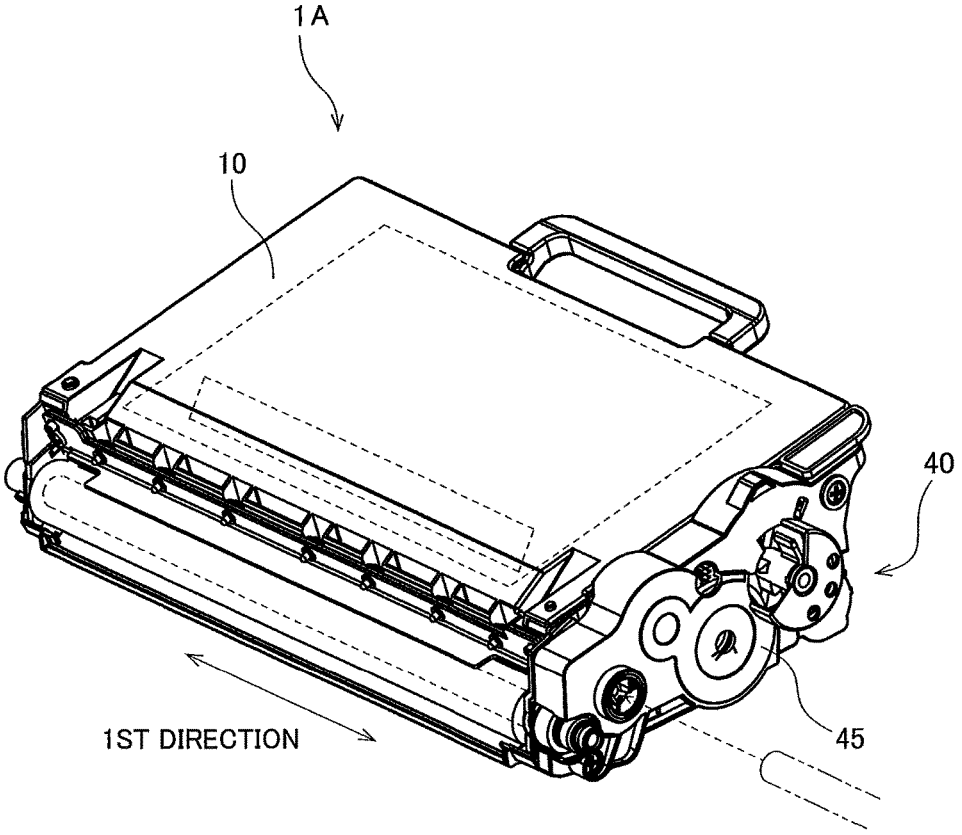
FIG. 20 is a perspective view of a developing cartridge according to a sixth modification.
Figure 21:
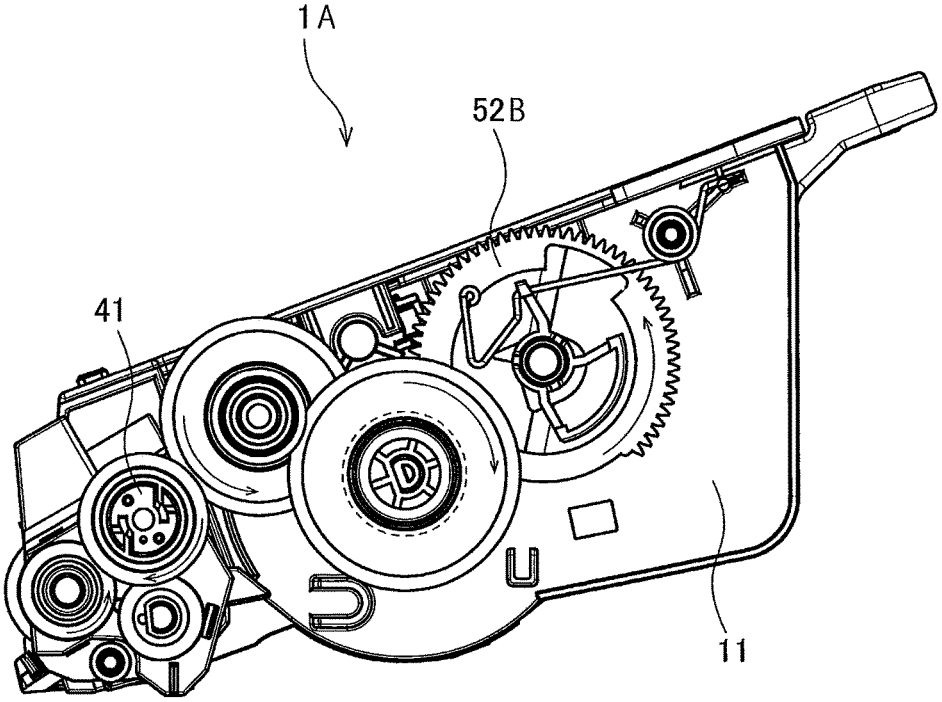
FIG. 21 is a plan view of the developing cartridge according to the sixth modification, and particularly showing a gear portion as viewed in a first direction after removal of a cover.
Figure 22:
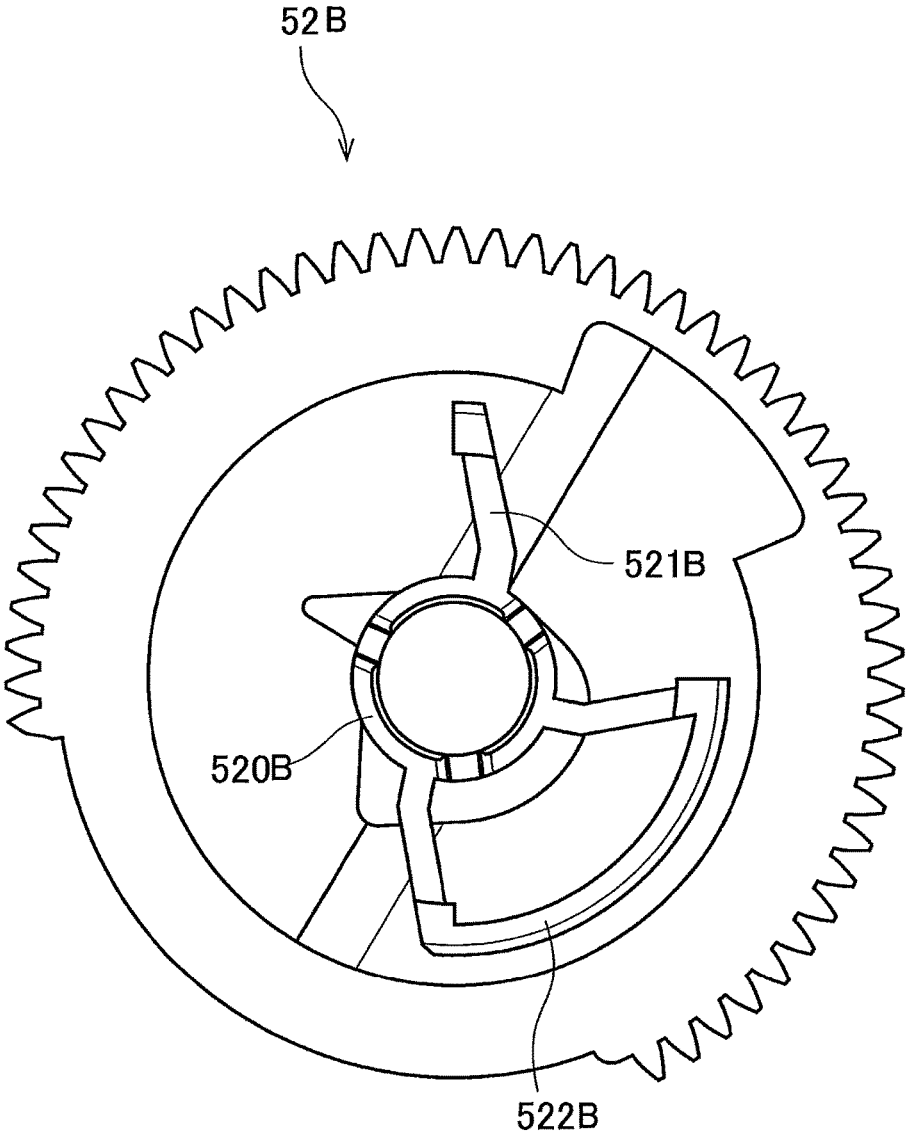
FIG. 22 is a plan view of a detection gear according to the sixth embodiment.

A developing cartridge 1A according to a sixth modification is illustrated in FIGS. 20 through 22 wherein like parts and components are designated by the same reference numerals as those shown in the above-described embodiment. According to this modification, the first gear portion 40 is provided only at the first end face 11 in the first direction. The first gear portion 40 is covered by the first cover 45. FIG. 21 is a plan view of the developing cartridge 1A, and particularly showing the first gear portion 40 as viewed in the first direction after removal of the cover 45. As illustrated in FIG. 21, the coupling 41 and a plurality of gears including the detection gear 52A are positioned or aggregated at the first end face 11 of the casing 10. Incidentally, the cartridge IC may be positioned at the second end face 12 of the casing 10.

A detection gear 52B is illustrated in FIG. 22. The detection gear 52B includes a sleeve portion 520B, a first protrusion 521B, and a second protrusion 522B. The sleeve portion 520B extends from one end face of the detection gear 52B in the first direction. The first protrusion 521 B and second protrusion 522B extend radially outwardly from the sleeve portion 520B at different circumferential positions from each other. Further, the second protrusion 522B has a peripheral length greater than that of the first protrusion 521B.

8-7. Seventh Modification

Figure 23:
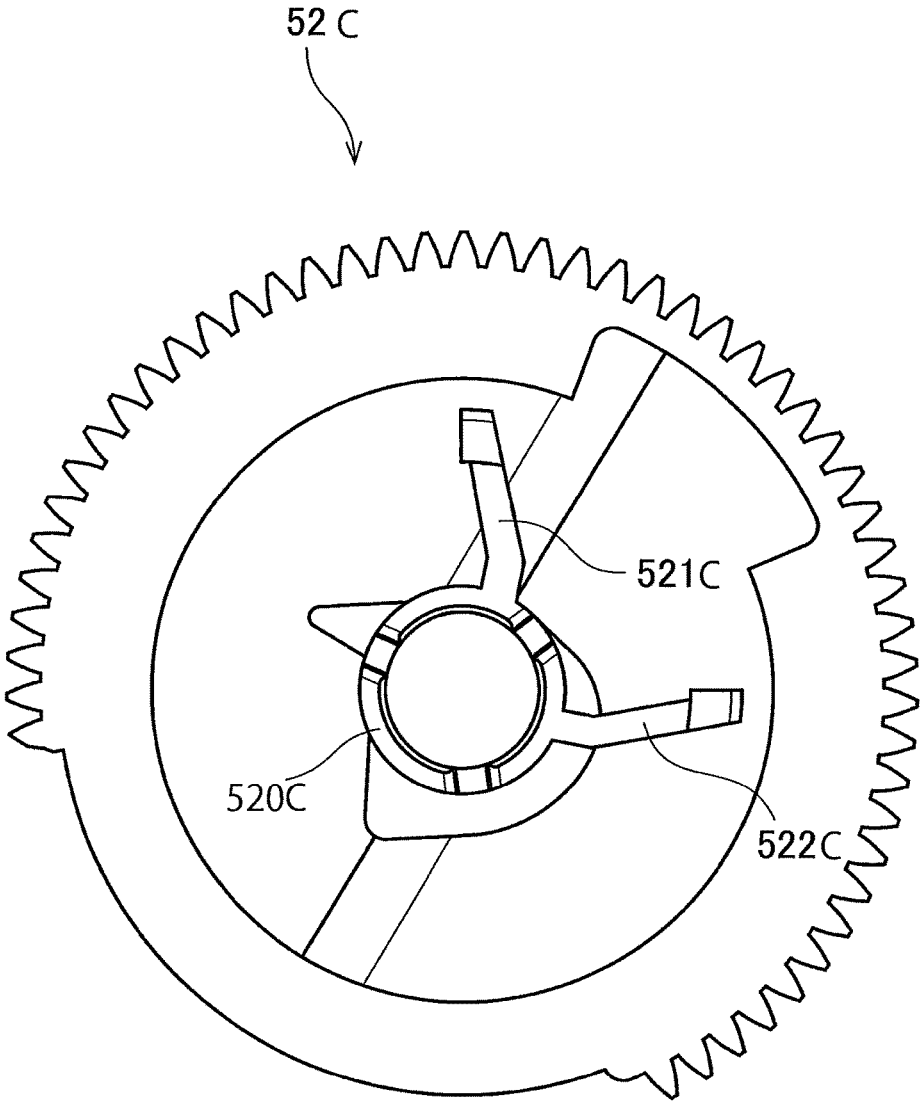
FIG. 23 is a plan view of a detection gear according to a seventh embodiment.

As illustrated in FIG. 23, in the seventh modification, a detection gear 52C includes a sleeve portion 520C, a first protrusion 521C, and a second protrusion 522C. The first and second protrusions 521C, 522C have peripheral lengths equal to each other. In other words, the peripheral length of the second protrusion 522C in the seventh modification is smaller than the peripheral length of the second protrusion 522B in the sixth modification. The second yield information may be changed by changing the peripheral length of the second protrusion.

8-8 Eighth Modification

Figure 24:
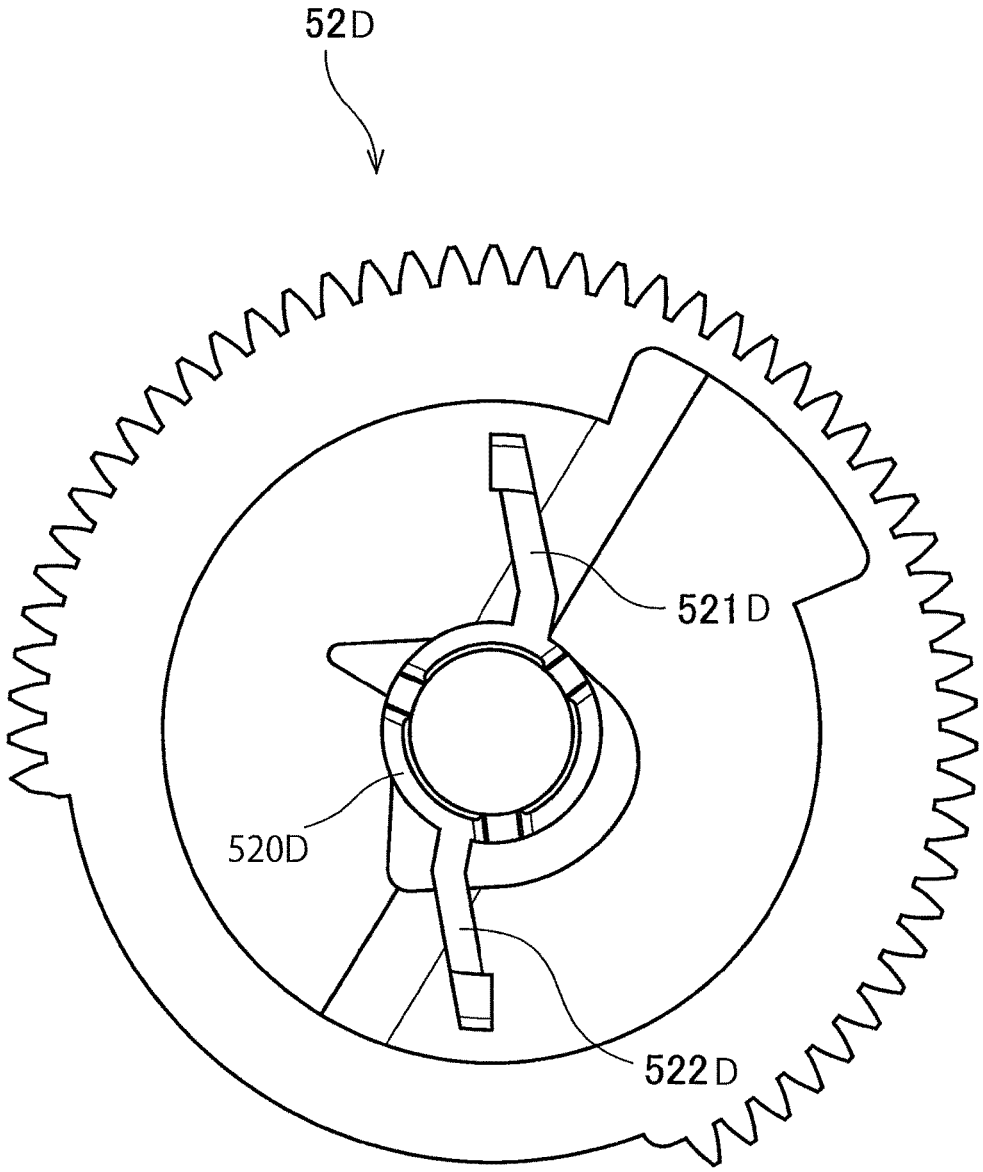
FIG. 24 is a plan view of a detection gear according to an eighth embodiment.

As illustrated in FIG. 24, in the eighth modification, a detection gear 52D includes a sleeve portion 520D, a first protrusion 521D, and a second protrusion 522D. The first and second protrusions 521D, 522D have peripheral lengths equal to each other. In other words, the peripheral length of the second protrusion 522D in the eighth modification is smaller than the peripheral length of the second protrusion 522B in the sixth modification. The second yield information may be changed by changing the peripheral length of the second protrusion.

Further, in the eighth embodiment, a distance in a circumferential direction between the first protrusion 521D and the second protrusion 522D is greater than that between the first protrusion 521C and the 522C in the seventh modification. The second yield information may be changed by changing the distance in the peripheral direction between the first and second protrusions.

8-9 Ninth Modification

Figure 25:
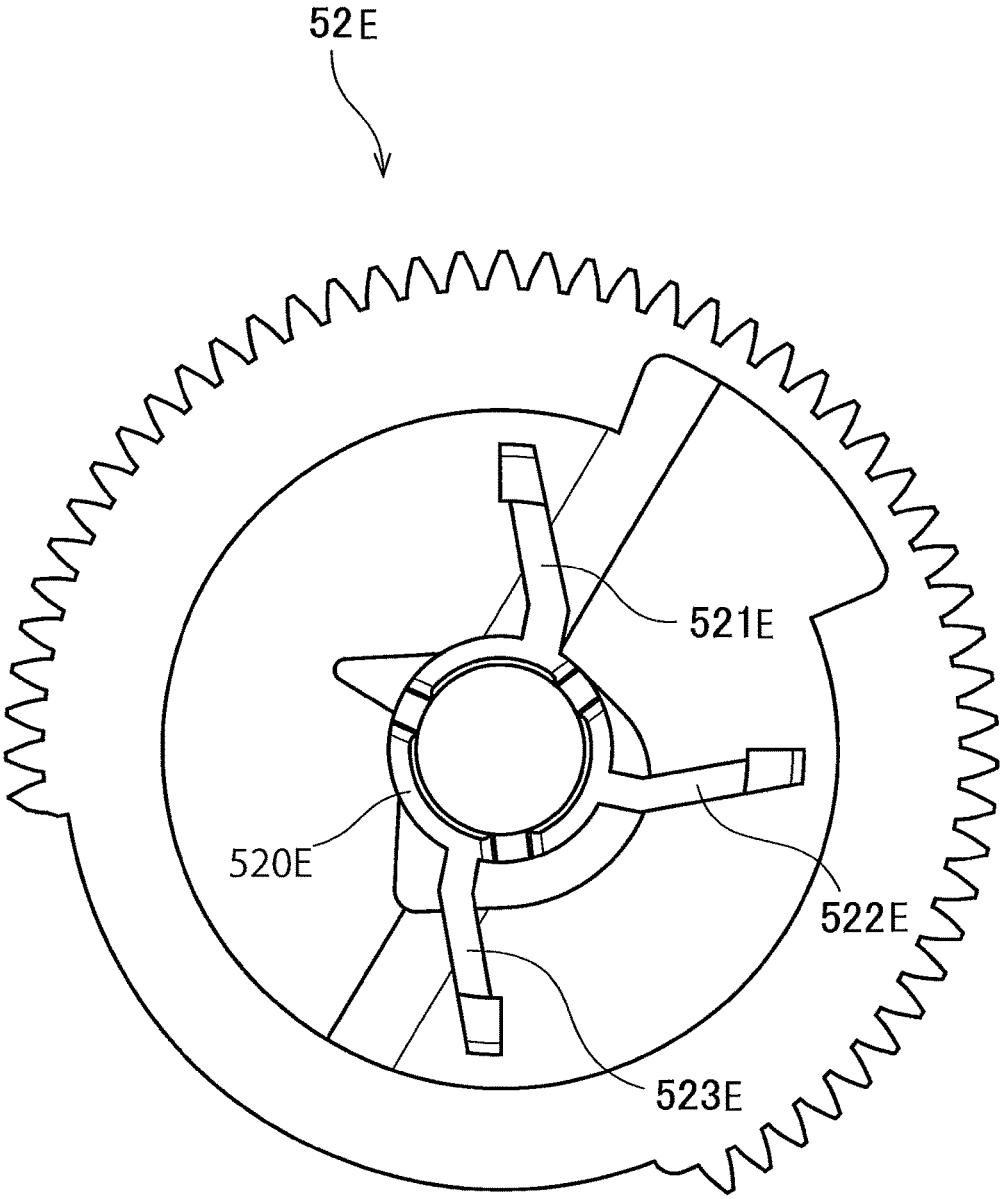
FIG. 25 is a plan view of a detection gear according to a ninth embodiment.

As illustrated in FIG. 25, in the ninth modification, a detection gear 52E includes a sleeve portion 520E, a first protrusion 521E, a second protrusion 522E, and a third protrusion 523E. The first, second, and third protrusions 521E, 522E, 523E extend radially outwardly from the sleeve portion 520E, and are positioned at circumferential positions different from each other. By providing three protrusions at the detection gear 52E, detection signals from the optical sensor can be changed in accordance with the change in circumferential distance between neighboring protrusions, and length in the circumferential direction. Accordingly, three protrusions can represent the increased numbers of the second yield information different from each other. Incidentally, not less than four protrusions may be provided at the detection gear 52E.

8-10 Other Modifications

According to the above-described embodiment, the cartridge IC having electrically contact surface is fixed to the outer surface of the holder. However, only the electrical contact surface may be fixed to the outer surface of the holder, and a memory of the cartridge IC may be provided at the developing cartridge at a position other than the outer surface.

Further, according to the above-described embodiment, the first portion and second gear portion are engaged with each other by meshing engagement between one or more of the plurality of gear teeth of the first gear portion and one or more of the plurality gear teeth of the second gear portion. However, the first gear portion and second gear portion may be engaged with each other by frictional force. For example, friction members such as a rubber may be provided at positions instead of the plurality of gears.

Further, the notification such as error message is output by displaying information on the display of the image forming apparatus. However, at least one of buzzer, voice, a warning light, and printing are available for the notification instead of or in addition to displaying the information on the display.

According to the above-described embodiment, the developing cartridge 1 is attachable to the drawer unit 91. However, a developing cartridge may be attached to a drum cartridge having a single photosensitive drum. Further, a developing cartridge may be a process cartridge having a photosensitive drum. Here, the process cartridge is a single cartridge having a developing roller and a photosensitive drum. Further, instead of the developing cartridge 1, a toner cartridge is available in which a toner is accommodatable and a developing roller is not provided.

Further, in the above-described embodiment, the optical sensor 913 detects the displacement of the lever 912. However, a detection mechanism capable of detecting electrical connection can be used instead of the optical sensor 913. In this case, one of the first, second, and third protrusions 521, 522, 523 is in contact with the lever 912. When the lever 912 is positioned at the second position, electrical connection in an electrical circuit provided in the image forming apparatus is rendered ON. The detection mechanism detects ON state of the electrical circuit. On the other hand, neither one of the first, second, and third protrusions 521, 522, 523 is in contact with the lever 912, the lever 912 is positioned at the first position, and the electrical connection in the electrical circuit is rendered OFF. The detection mechanism detects the OFF state.

Further, details of the developing cartridge can be different from those illustrated in the drawings. Further, various combinations would be conceivable by picking up respective components in the embodiment and modifications and combining these components together without conflicting the teachings of the embodiment and modifications.

While the description has been made in detail with reference to specific embodiments thereof, it would be apparent to those skilled in the art that various changes and modifications may be made therein without departing from the spirit and scope of the above described embodiments.

What is claimed is:

1. A cartridge comprising:

a detection gear rotatable about an axis extending in a predetermined direction, the detection gear including a protrusion movable with rotation of the detection gear; and a memory including a storage region configured to store new product determination information representing that the cartridge is detected as a new product in response to motion of the protrusion and a determination that the new product determination information is not stored in the storage region.

2. The cartridge according to claim 1, wherein the storage region does not store the new product determination information when the cartridge is shipped.

3. The cartridge according to claim 1, wherein the cartridge is configured to accommodate a developing agent; and wherein the memory further includes a second storage region configured to store yield information representing at least one of amount of the developing agent in the cartridge and the number of sheets printable by the developing agent in the cartridge, the yield information being determinable by the motion of the protrusion.

4. The cartridge according to claim 3, wherein the detection gear further includes a second protrusion movable with rotation of the detection gear; and wherein the yield information is determinable by the motion of the protrusion and the motion of the second protrusion.

5. The cartridge according to claim 3, wherein the second storage region does not store the new product determination information when the cartridge is shipped.

6. The cartridge according to claim 3, wherein the memory further includes a third storage region configured to store remaining amount information representing remaining amount of the developing agent in the cartridge, the remaining amount information being determinable by the yield information and used amount of the developing agent.

7. The cartridge according to claim 6, wherein the third storage region does not store the remaining amount information when the cartridge is shipped.

8. The cartridge according to claim 3, further comprising a coupling configured to receive a drive force; and wherein the detection gear is rotatable by the drive force.

9. The cartridge according to claim 8, further comprising:

a developing roller rotatable about a second axis extending in the predetermined direction, the developing roller including a developing roller shaft extending in the predetermined direction; and a developing roller gear mounted to the developing roller shaft and the developing roller gear being rotatable together with the developing roller; and wherein the coupling is rotatable about a third axis extending in the predetermined direction, and the coupling further includes a coupling gear rotatable together with the coupling and the coupling gear engaging with the developing roller gear.

10. The cartridge according to claim 9, further comprising a supply roller rotatable about a fourth axis extending in the predetermined direction and the supply roller configured to supply the developing agent to the developing roller.

11. The cartridge according to claim 1, wherein the memory stores authentication information.

12. The cartridge according to claim 1, further comprising an IC chip including the memory.

13. The cartridge according to claim 1, wherein the determination that the new product determination information is not previously stored in the storage region is performed by an image forming apparatus.

14. An image forming apparatus comprising:

a cartridge including:

a detection gear rotatable about an axis extending in a predetermined direction, the detection gear including a protrusion movable with rotation of the detection gear;

a memory including a storage region;

a frame configured to hold the cartridge;

a sensor configured to detect the motion of the protrusion; and a controller configured to:

determine whether a detection signal which is detected by the sensor is a new product waveform representing that the cartridge is a new product in response to motion of the protrusion, and write, in the storage region, new product determination information representing that the cartridge is detected as a new product, when the controller determines that the detection signal is the new product waveform.

15. The image forming apparatus according to claim 14, wherein the controller is configured to:

determine whether the new product determination information is stored in the storage region when the sensor detects the detection signal, and write the new product determination information in the storage region, when the controller determines that the detection signal is the new product waveform and the new product determination information is not stored in the storage region.

16. The image forming apparatus according to claim 14, wherein the controller is configured to:

determine whether the new product determination information is stored in the storage region when the sensor detects the detection signal, and output a notification, when the controller determines that the detection signal is the new product waveform and new product determination information is stored in the storage region.

17. The image forming apparatus according to claim 16, further comprising a display configured to display information related to the notification.

18. The image forming apparatus according to claim 14, wherein the controller is configured to:

determine whether the new product determination information is stored in the storage region when the sensor detects the detection signal, and output a notification, when the controller determines that the detection signal is not the new product waveform and the new product determination information is not stored in the storage region.

19. The image forming apparatus according to claim 14, wherein the cartridge is configured to accommodate a developing agent;

wherein the memory further includes a second storage region; and wherein the controller is further configured to:

acquire, based on the detection signal, yield information representing at least one of amount of the developing agent in the cartridge and the number of printable sheets by the developing agent in the cartridge, and write the yield information in the second storage region.

20. The image forming apparatus according to claim 19, wherein the controller is further configured to:

confirm used amount of the developing agent in the cartridge; and determine, based on the yield information and the used amount of the developing agent, remaining amount information representing remaining amount of the developing agent.

21. The image forming apparatus according to claim 20, wherein the memory further includes a third storage region; and wherein the controller is further configured to write the remaining amount information in the third storage region.

22. The image forming apparatus according to claim 14, wherein the cartridge is configured to accommodate a developing agent;

wherein the memory further includes a second storage region;

wherein the detection gear further includes a second protrusion movable with rotation of the detection gear;

wherein the sensor is configured to detect the motion of the protrusion and the motion of the second protrusion; and wherein the controller is further configured to:

acquire, based on the detection signal, yield information representing at least one of amount of the developing agent in the cartridge and the number of printable sheets by the developing agent in the cartridge, and write the yield information in the second storage region.

23. The image forming apparatus according to claim 14, wherein the cartridge further includes an IC chip including the memory.

* * * * *